US005558302A

United States Patent [19]

Jesperson

[11] Patent Number: 5,558,302

[45] Date of Patent: Sep. 24, 1996

[54] FLEXIBLE SHEET MATERIAL DISPENSER WITH AUTOMATIC ROLL TRANSFERRING MECHANISM

[75] Inventor: Paul W. Jesperson, Salt Lake City, Utah

[73] Assignee: Georgia-Pacific Corporation, Atlanta, Ga.

[21] Appl. No.: 384,923

[22] Filed: Feb. 7, 1995

[51] Int. Cl.[6] ..... B65H 19/10

[52] U.S. Cl. ..... 242/560

[58] Field of Search ..... 242/558, 559, 242/559.1, 559.3, 559.4, 560, 560.1, 560.2, 560.3, 561, 598.6

[56] References Cited

U.S. PATENT DOCUMENTS

| | | | |
|---|---|---|---|
| 3,700,181 | 10/1972 | Diring et al. | 242/561 |
| 3,770,222 | 11/1973 | Jespersen | 242/560.3 |
| 3,771,739 | 11/1973 | Nelson | 242/560.3 |
| 3,851,810 | 12/1974 | Jespersen | 226/121 |
| 3,865,395 | 2/1975 | Okamura | 242/560 |
| 4,137,805 | 2/1979 | DeLuca et al. | 242/560.1 |
| 4,203,562 | 5/1980 | DeLuca et al. | 242/560.1 |
| 4,307,638 | 12/1981 | DeLuca et al. | 242/560.1 |
| 4,307,639 | 12/1981 | DeLuca | 242/560.1 |
| 4,340,195 | 7/1982 | DeLuca | 242/560 |
| 4,404,880 | 9/1983 | DeLuca | 242/527.1 |
| 4,441,392 | 4/1984 | DeLuca | 242/564.4 |
| 4,487,375 | 12/1984 | Rasmussen et al. | 242/560.1 |
| 4,712,461 | 12/1987 | Rasmussen | 83/334 |
| 4,732,306 | 3/1988 | Jeperson | 225/2 |
| 4,844,361 | 7/1989 | Granger | 242/561 |
| 4,856,724 | 8/1989 | Jespersen | 242/560.1 |
| 4,944,466 | 7/1990 | Jespersen | 242/560.3 |
| 5,172,840 | 12/1992 | Bloch et al. | 225/37 |
| 5,244,161 | 9/1993 | Wirtz-Odenthal | 242/560.1 |
| 5,271,574 | 12/1993 | Formon et al. | 242/560.3 |
| 5,288,032 | 2/1994 | Boone et al. | 242/560.3 |

*Primary Examiner*—John P. Barling
*Attorney, Agent, or Firm*—Banner & Allegretti, Ltd.

[57] ABSTRACT

A dispenser for dispensing up to approximately one and one-half rolls of flexible sheet material. The dispenser includes a dispensing mechanism and a roll transfer and supporting mechanism. The roll transfer and supporting mechanism includes a pair of guide tracks, a pivotally spring biased sensor plate, a pair of opposing reserve roll supports, a pair of transfer links each connecting the sensor plate to a respective reserve roll support, a support roller, and a support surface located below the support roller. The guide tracks guide the core ends of the rolls through the dispenser. The reserve roll supports are pivotally mounted adjacent the upper end of the guide tracks, and hold a roll in a reserve position when a dispensing roll is smaller than a first predetermined diameter and greater than a second predetermined diameter. The pivotally mounted sensor plate senses the diameter of the dispensing roll and is coupled to the reserve roll supports, via the transfer links, to control the reserve roll supports in accordance with the sensed diameter.

40 Claims, 13 Drawing Sheets

FLEXIBLE SHEET MATERIAL DISPENSER WITH AUTOMATIC ROLL TRANSFERRING MECHANISM

TECHNICAL FIELD

This invention relates to dispensers for flexible sheet material, such as paper towels. More particularly, this invention relates to a dispenser having an automatic roll transfer device which can dispense sheet material from a plurality of rolls, wherein the dispenser is sized to be no larger than a typical single roll dispenser.

BACKGROUND OF THE INVENTION

Numerous types of dispensers for flexible sheet material wound on cores, such as rolls of paper towels, are known in the prior art. The core on which the flexible sheet material is wound typically has supporting spindles or protrusions extending beyond the ends of the rolls. The spindles are used to support the roll in, and guide it through, the dispenser. These dispensers can basically be classified into two groups. Dispensers in the first group are sized to contain a single roll of flexible sheet material and dispense flexible sheet material from the roll. Dispensers in the second group are sized to contain a plurality of rolls of flexible sheet material, dispense flexible sheet material from a roll in a dispensing position, and automatically transfer a roll from a reserve position to a dispensing position.

The first group of dispensers, i.e., single roll dispensers, are conveniently sized to fit into many institutional or public restrooms. However, because they only contain a single roll at a given time, maintenance personnel are forced to either: (a) replace partially used rolls, or (b) wait until the rolls are entirely depleted which typically leaves users without paper towels. Thus, if maintenance personnel replace partially used rolls, the dispensers are deficient because they increase waste and roll supply costs. Alternatively, if maintenance personnel elect not to replace the rolls until the rolls are fully or substantially depleted, the dispensers are deficient because they leave users without paper towels. Further, these dispensers require a high maintenance cost due to the high frequency of inspection inherent in single roll dispensers.

The second group of dispensers, i.e., the multiple roll dispensers, overcome many of the aforementioned problems associated with the first group of dispensers. However, they require additional mounting space because they can be two or more times the size of the single roll dispensers. This results in dispensers that may be difficult and/or undesirable to mount conveniently in public or institutional restrooms due to their size.

U.S. Pat. No. 4,944,466 to Jespersen, which is incorporated herein by reference, discloses a dispenser which falls into the second group. The dispenser includes an automatic roll transferring system having side tracks, a holding lever, a retaining plate, and a spring biased sensing plate. The holding lever has a lower projection for holding a dispensing roll in a dispensing position and an upper projection for holding a reserve roll in a reserve position. When the diameter of the dispensing roll is greater than a predetermined diameter, the sensing plate is in a first position, which in turn, keeps the retaining plate in a position to lock the holding lever. Once the dispensing roll is depleted to a size less than the predetermined diameter, the sensing plate moves under its spring biasing to move the retaining plate unlocking the holding lever. When holding lever is unlocked, the weight of the reserve roll causes holding lever to rotate and the reserve roll falls down the guide tracks into the dispensing position. The continued dispensing of the substantially depleted roll automatically initiates the feeding of the sheet material from the recently dropped reserve roll. When the dispensing roll is in a dispensing position, it is either (i) supported by its core or (ii) supported initially by a supporting roller and later supported by its core. However, as previously described, the dispenser contains two full rolls and is significantly larger than a single roll dispenser, and thus, it may be difficult and/or undesirable to mount conveniently in certain public and institutional restrooms.

Therefore, a dispenser was thus needed which would overcome the problems of leaving users without paper towels and the high maintenance and material costs associated with single roll dispensers, and which would also overcome the size and mounting limitations associated with the larger multiple roll dispensers. The present invention was developed to accomplish this objective.

SUMMARY OF THE INVENTION

The invention relates to a roll towel dispenser which can house up to approximately one and one-half rolls of flexible sheet material. The dispenser includes a dispensing mechanism and a roll transfer and supporting mechanism. The roll transfer and supporting mechanism includes a pair of guide tracks, a pivotally spring biased sensor plate, a pair of opposing reserve roll supports, a pair of transfer links each connecting the sensor plate to a respective reserve roll support, and at least one support roller. The guide tracks guide the core ends of the rolls through the dispenser. The reserve roll supports are pivotally mounted adjacent the upper end of the guide tracks, and hold a roll in a reserve position when a dispensing roll is smaller than a first predetermined diameter and greater than a second predetermined diameter. The pivotally mounted sensor plate senses the diameter of the dispensing roll and is coupled to the reserve roll supports, via the transfer links, to control the reserve roll supports in accordance with the sensed diameter.

In one embodiment, a dispenser dispenses rolls of flexible sheet material wound on cores having ends extending beyond the sides of the rolls. The dispenser includes a housing, a support device, a dispensing mechanism, a reserve roll support, a sensing mechanism, and a coupling device. The housing includes opposite side walls each having a guide track for receiving and guiding the core ends. The support device is supported in the housing between the side walls for contacting a supporting roll of flexible sheet material during a portion of the dispensing of the sheet material from the dispenser. The dispensing mechanism is supported in the housing laterally of the support device for dispensing sheet material from a dispensing roll out of the dispenser. The reserve roll support is pivotally attached to a side wall adjacent an upper portion of a guide track. The reserve roll support exhibits a first state in which it permits a reserve roll of flexible sheet material at an upper reserve position to freely travel downward along the guide tracks and onto the support device, and a second state in which at least a portion of the reserve roll support is located in its guide track for retaining a reserve roll of flexible sheet material at an upper reserve position and preventing the reserve roll from travelling downward along the guide tracks and onto the support device. The sensing mechanism is mounted in the housing and between the side walls for sensing the diameter of the dispensing roll as sheet material is dispensed from the dispensing roll. Further, the sensing mechanism is movable between: (i) a releasing position when the dispensing roll has a diameter (a) greater than a first predetermined diameter or (b) smaller than a second predetermined diameter, and (ii) a retaining position when the dispensing roll has a diameter less than the first predetermined diameter and greater than the second predetermined diameter. Additionally, the coupling device is functionally coupled to the sensing mechanism and to the reserve roll support. Further, the coupling device places the reserve roll support into the first state when the sensing mechanism is in a releasing position, and places the reserve roll support into the second state when the sensing mechanism is in a retaining position.

In another embodiment, a dispenser dispenses rolls of flexible sheet material wound on cores. The dispenser includes: a housing, a support member, and a dispensing mechanism supported in the housing laterally of the support member for dispensing sheet material from a dispensing roll and out of the dispenser. The housing includes opposite side walls, each with a guide track for receiving and guiding the core ends of the dispensing roll. Each guide track includes an arcuate portion. The support member is supported in the housing for contacting and supporting the dispensing roll during a portion of the dispensing of the sheet material from the dispensing roll. The arcuate guide track portions include a path being substantially radially spaced from the support member. Additionally, the dispensing roll travels from an upper portion of the housing to a lower portion of the housing upon reaching a predetermined diameter. The core ends of the dispensing roll are guided in the arcuate portions of the guide tracks as the dispensing roll travels from the upper portion of the housing to the lower portion of the housing. Further, the support member supports the dispensing roll for at least a portion of its travels within the arcuate guide track portions.

In yet another embodiment, a dispenser dispenses rolls of flexible sheet material wound on cores having ends extending beyond the sides of the rolls. The dispenser includes a housing, a support member, a dispensing mechanism supported in the housing laterally of the support member for dispensing sheet material from the dispensing roll and out of the dispenser, a reserve roll support, and a sensing mechanism. The housing includes opposite side walls, each having a guide track for receiving and guiding the core ends. The support member is supported in the housing adjacent the guide track for contacting a roll of flexible sheet material during a portion of the dispensing of the sheet material from the dispenser. Further, the reserve roll support is pivotally attached to a side wall for movement about a pivot axis. The reserve roll support is movable between a first position in which a reserve roll of flexible sheet material can freely move downward along the guide tracks to be supported by the support member, and a second position located within the guide track its side wall for supporting a reserve roll of flexible sheet material at an upper reserve position above the support member. The pivot axis is located adjacent an upper end of the guide track of its side wall. Additionally, the sensing mechanism senses the diameter of the dispensing roll and controls the movement of the reserve roll support in accordance with the sensed diameter of the dispensing roll.

The present invention is also directed to a method for dispensing sheet material from a dispenser wherein the sheet material is wrapped in a roll about a core and the sheet material is dispensed from the dispenser through a dispensing mechanism. A first roll of the sheet material is supported in the dispenser in a first supported position with the roll surface of the first roll in contact with a support member. Sheet material from the first roll is dispensed through the dispensing mechanism to diminish the diameter of the first roll in the first supported position until the first roll reaches a first predetermined diameter. Further, the first roll is guided downward from the first supported position in contact with the support member to a second supported position upon the first roll reaching a first predetermined diameter so that a free end of its sheet material remains in contact with the support member and threaded through the dispensing mechanism. A retaining mechanism is activated in response to the first roll being guided from the first supported position to the second supported position. A second roll is loaded into the dispensing mechanism. Additionally, the second roll is supported by the retaining mechanism in a reserve position out of contact with, and vertically above, the support member. Sheet material is dispensed from the first roll through the dispensing mechanism to diminish the diameter of the first roll in the second supported position until the first roll reaches a second predetermined diameter. The retaining mechanism is deactivated in response to the first roll reaching the second predetermined diameter. The second roll is guided downward from the reserve position to the first supported portion supported by, and in contact with, the support member upon the retaining mechanism being deactivated. Further, sheet material is dispensed from the second roll through the dispensing mechanism.

The present invention is also directed to another method for dispensing sheet material from a dispenser wherein the sheet material is wrapped in a roll about a core and the sheet material is dispensed from the dispenser through a dispensing mechanism. A first roll is supported by a first supporting member. A first amount of sheet material is then dispensed from the first roll while the first roll is being supported by the first supporting member. The first roll is permitted to fall by gravity from the first supporting member to a second supporting member upon the first roll reaching a first predetermined diameter. The first roll is supported by the second supporting member and a second amount of sheet material is dispensed from the first roll while the first roll is being supported by the second supporting member. Further, the first roll is permitted to fall by gravity from the second supporting member to a third supporting member upon the first roll reaching a second predetermined diameter, the second predetermined diameter being smaller than the first predetermined diameter. The first roll is supported inside the dispenser by the third supporting member. Additionally, the remaining amount of sheet material is dispensed from the first roll until the first roll is depleted.

The present invention alleviates the above-discussed problems of prior art dispensers. The dispenser of the present invention exhibits reduced maintenance and material costs associated with multiple roll dispensers, as it is capable of holding more than a single roll. Further, dispenser of the present invention is approximately the same size as some single roll dispensers, overcoming the size and mounting limitations associated with the larger multiple roll dispensers. Additionally, the present invention maximizes the useful area within the dispenser by providing a roll guide track having a portion being substantially radially spaced from a support roller. Further, the reserve roll supports are pivotally mounted adjacent the upper end of the guide tracks to reduce the required size of the reserve roll supports, and thereby enhancing the control of the reserve roll supports.

Further objects, features and other aspects of this invention will be understood from the following detailed description of the preferred embodiments of this invention with reference to the attached drawing figures.

DESCRIPTION OF THE PREFERRED EMBODIMENTS

Figure 1:
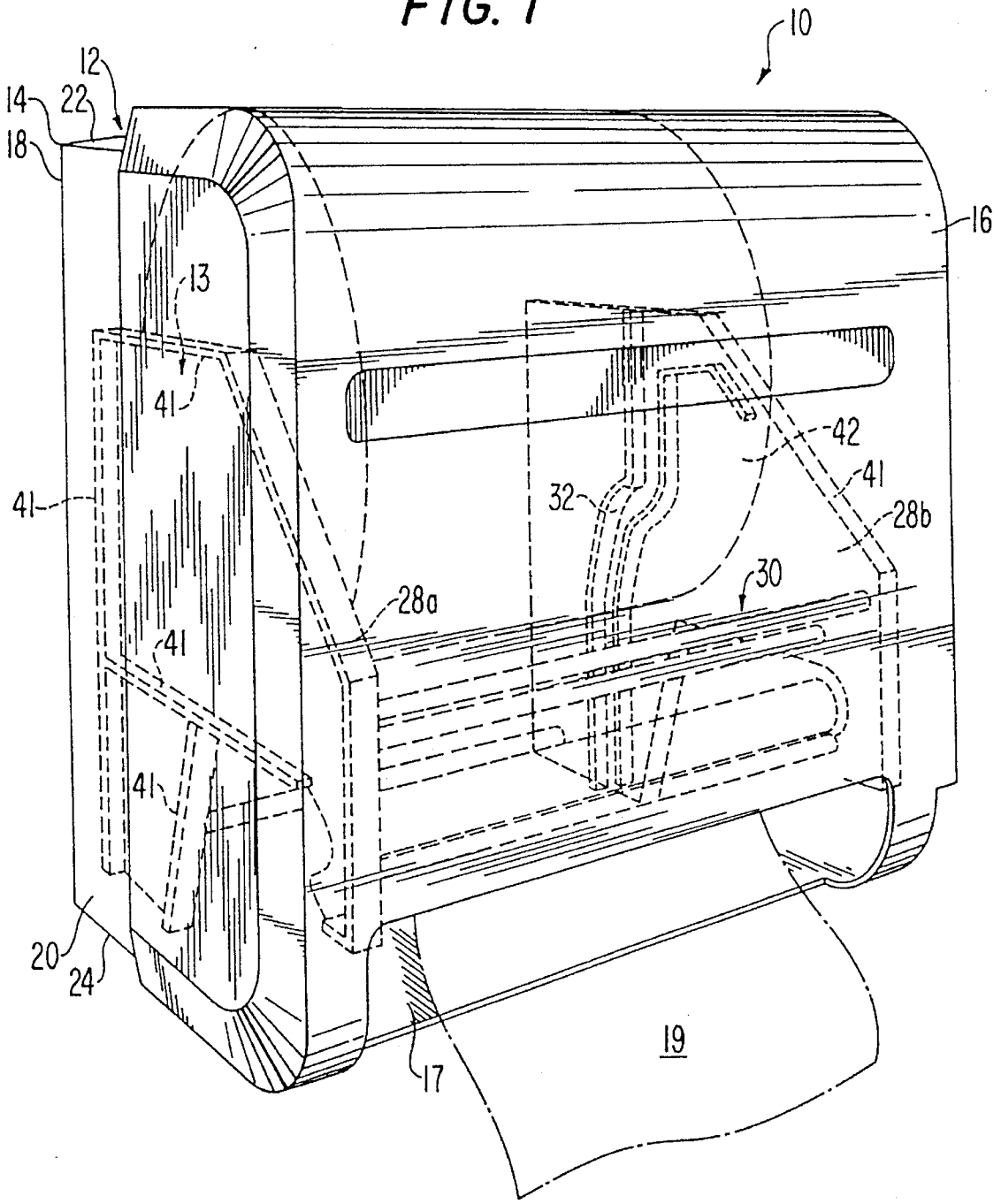
FIG. 1 is a perspective view of the roll dispenser of the present invention with a portion of the internal housing shown in phantom line to illustrate the relationship between the internal and external housings.

Referring to the drawings wherein like numerals indicate like elements, a dispenser, designated generally by reference numeral 10, is illustrated. Dispenser 10 houses and dispenses rolls of sheet material, such as paper towel and the like, wound over cores. As illustrated in FIG. 1, dispenser 10 generally includes an external housing 12 and an internal housing 13 removably attached inside external housing 12.

External housing 12 includes a back plate assembly 14 and a front cover 16. Back plate assembly 14 includes a back wall 18, and left and right side walls 20, a top wall 22, and a bottom wall 24, extending from back wall 18. Back wall 18, side walls 20, top wall 22, and bottom wall 24 are preferably made of a metal, e.g., steel, and are welded together to form back plate assembly 14. However, one skilled in the art would recognize that other materials and/or manufacturing techniques could be used.

Figure 2:
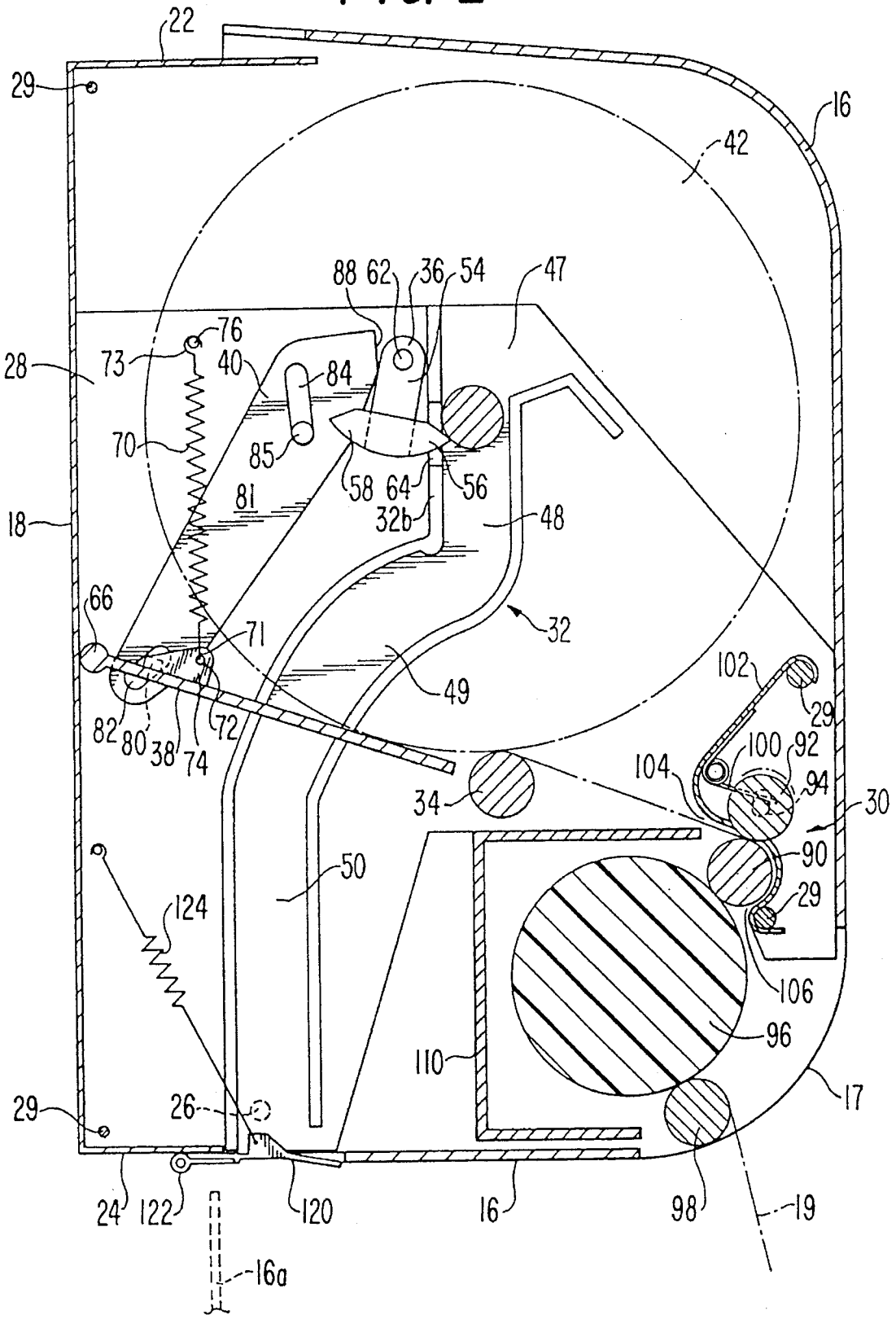
FIG. 2 is a side view, partially broken away and partially in section, of the roll dispenser of FIG. 1, having a roll transfer and supporting mechanism according to a first embodiment, and showing a dispensing roll in a first dispensing position during operation of the dispenser.

Cover 16 is mounted to side walls 20 for pivotal movement about pivot axis 26 in a well known manner. As shown in FIG. 2, cover 16 is movable between a closed position for dispensing sheet material, shown in solid line, and an open position for roll loading, partially shown in phantom line by reference numeral 16*a*. An arrangement to provide pivotal movement preferably includes outwardly extending pins or rods on side walls 20 with corresponding mating holes in cover 16. In the alternative, the arrangement could include inwardly extending pins or rods on cover 16 with corresponding mating holes in side walls 20. A locking arrangement, not shown, is preferably located between the top portion of cover 16 and top wall 22 and is used for selectively locking cover 16 in the closed position. Cover 16 further includes an opening 17 at its bottom front region to permit the dispensing of flexible sheet material 19 therethrough. Cover 16 is preferably made of a plastic material.

Figure 3:
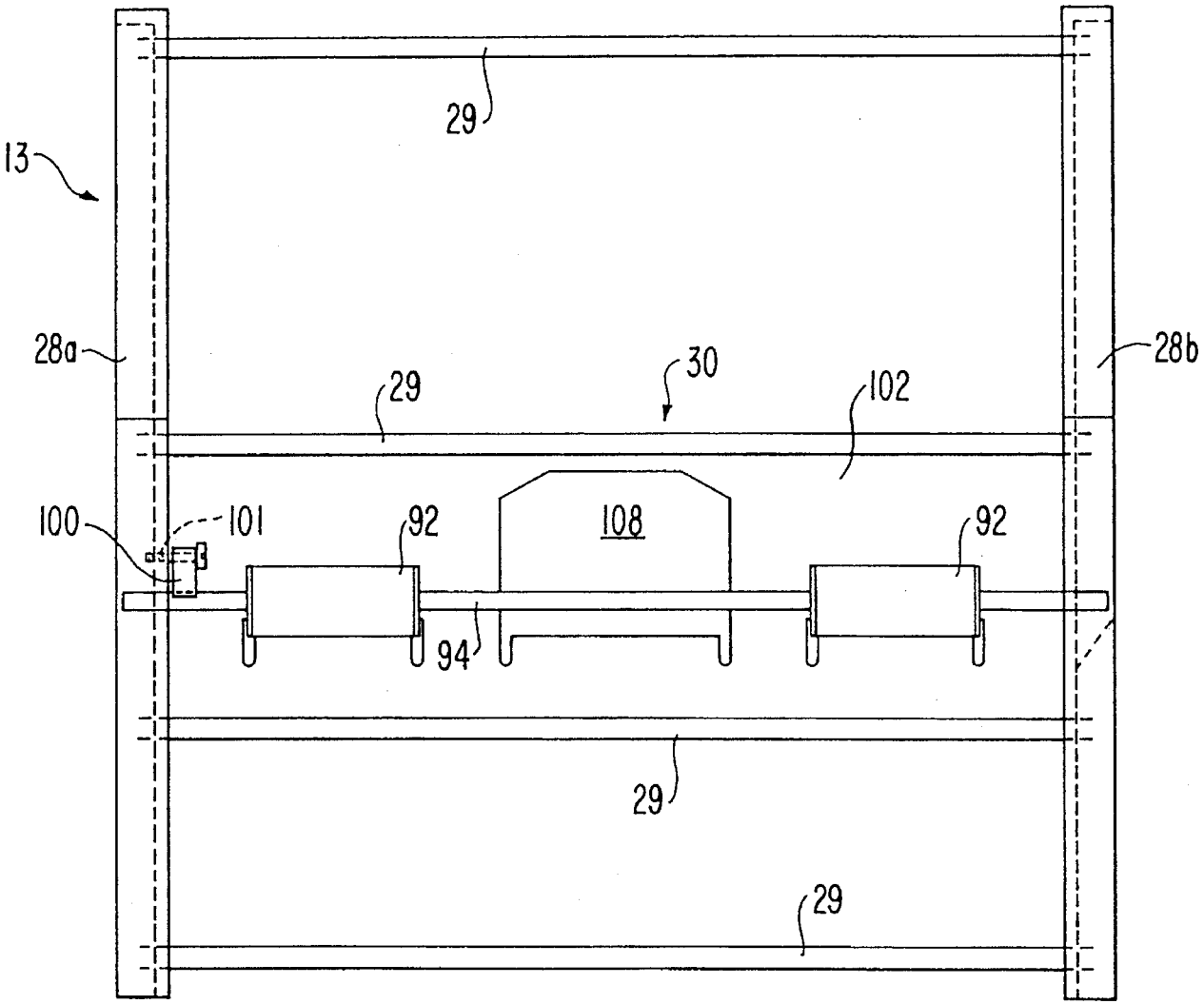
FIG. 3 is a front elevational view of the internal housing in a partially assembled state.

As shown in FIG. 3, internal housing 13 is a chassis formed of left and fight side walls or plates 28*a* and 28*b* which are held together in a spaced, parallel relationship by a plurality of spacer support rods 29 and a portion of a dispensing mechanism 30, which is described in detail hereinafter. Side plates 28 each include a number of spacer support rod holes 31 to accommodate spacer support rods 29. Spacer support rods 29 are preferably externally threaded rods which extend through holes 31 and are attached to the outside surfaces of side plates 28 by fastening hardware, e.g., washers and nuts, not shown.

Upon assembly, internal housing 13 is attached to back wall 18 or side walls 20 of back plate assembly 14 in a conventional manner. For example, if internal housing 13 is attached to side walls 20, screws, nuts and bolts, or other fastening devices may be used to affix each side plate 28 to a respective side wall 20. If internal housing 13 is attached to back wall 18, clips or brackets may be provided on back wall 18 to clampingly engage one or more spacer support rods 29 adjacent the rear portion of internal housing 13.

As depicted in FIGS. 2, 4, and 9–13, internal housing 13 includes a roll transfer and supporting system which supports and transfers the sheet material rolls from an initial stage when a roll is in a non-dispensing reserve position, to a final stage in which the roll is entirely depleted. The roll transfer and supporting system generally includes opposing guide tracks 32, a support roller 34, a supporting surface located beneath support roller 34, reserve roll supports 36, a sensor plate 38, and transfer links 40.

Figure 4:
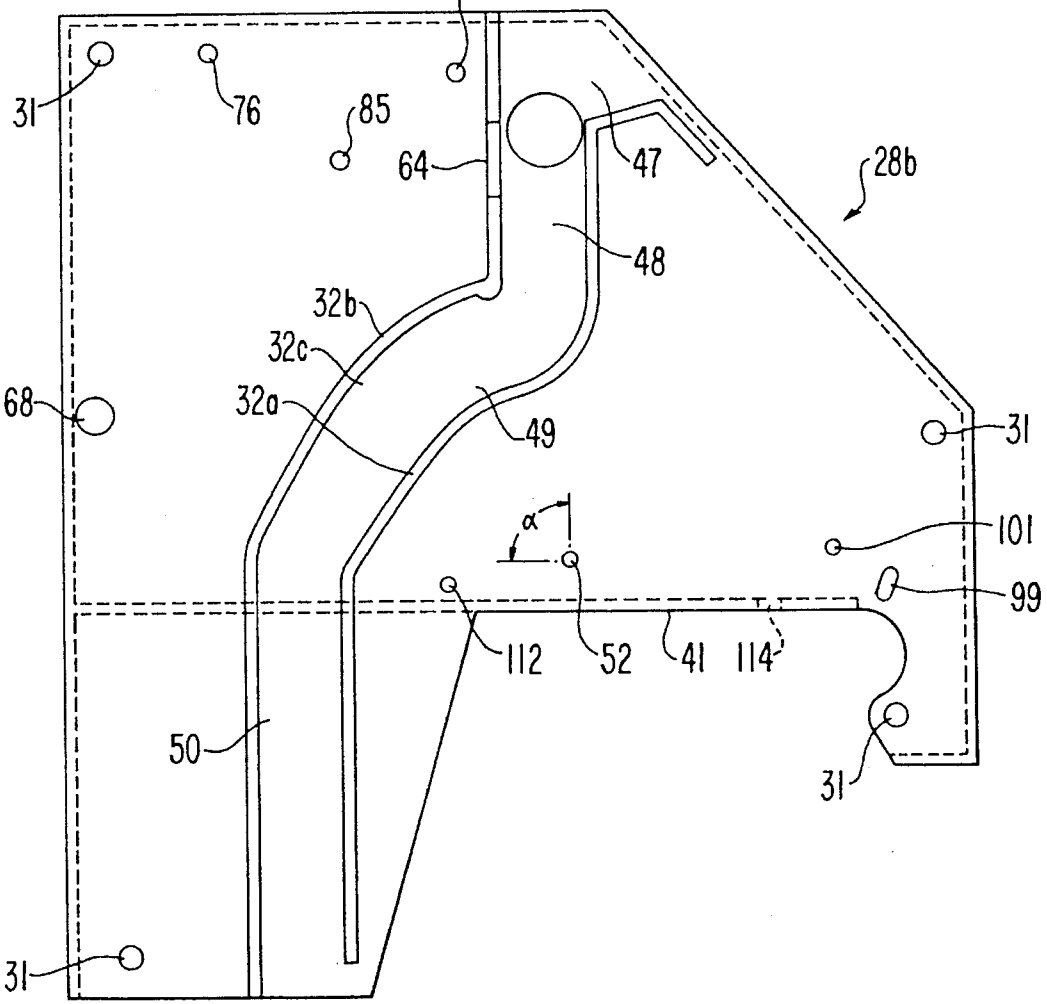
FIG. 4,is an elevational view of the inner surface of the right side plate.

FIG. 4 shows the inner surface of fight side plate 28*b* . Left side plate 28*a* is essentially symmetrical to fight side plate 28*b* except primarily for the size of its guide track as described below. Left and right side plates 28*a* and 28*b* are preferably each formed of a single molded piece of plastic, and the outside of each side plate 28 includes strengthening ribs 41 providing additional rigidity and strength. The inside of each side plate 28 includes a guide track 32 thereon or therein which guides a respective core end from a roll 42 of sheet material as it advances from the top to the bottom of dispenser 10.

One of the two guide tracks, e.g., the left track, is narrower than the other to assure proper orientation of the rolls of sheet material which are inserted into dispenser 10. Otherwise, with respect to the roll transfer and supporting system, dispenser 10 is symmetrical so that similar components are located on both the left and right sides of dispenser 10.

Figure 14:
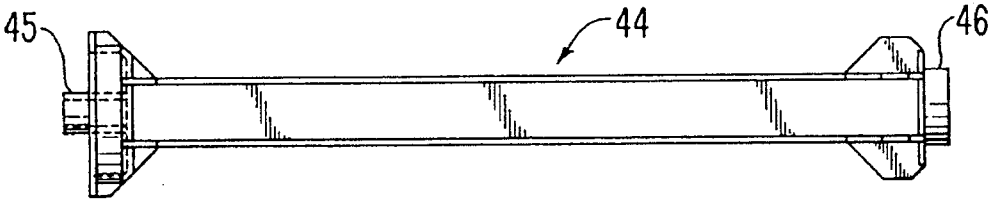
FIG. 14 is an elevational view of a roll core support used in the dispensing mechanism according to the present invention.

Roll cores for assuring proper roll orientation within a dispenser having guide tracks 32 of different widths are well known. One example is illustrated in FIG. 14 and includes a roll core 44 having a first end with a substantially circular projection 45 and a second end with another substantially circular projection 46. The diameter of projection 45 at the first end is smaller than the diameter of projection 46 at the second end. Further, the diameter of larger projection 46 is larger than the width of narrower guide track and smaller than the width of its intended the wider guide track. Proper orientation at the roll is thereby assured as the larger projection 46 is prevented from fitting within the narrower guide track. Further details of roll cores for assuring proper roll orientation within guide tracks are included in U.S. Pat. No. 4,944,466 to Jespersen, which has been incorporated herein by reference.

As depicted in FIG. 4, each guide track 32 includes inwardly extending, opposed guide surfaces 32*a* and 32*b* to form a channel 32*c* therebetween. Each guide track 32 is continuous from substantially the top to bottom of internal housing 13, and further includes a widened entry area 47, a first or upper vertical portion 48, a curved central portion 49, and a second or lower vertical portion 50. Guide tracks 32 help support and guide the core ends of the rolls through housing 13.

Widened entry area 47 of guide track 32 is an enlarged section of track 32 adjacent the top of internal housing 13. This facilitates the loading of an initial dispensing roll or a reserve roll into dispenser 10 by providing an entrance track section with wider tolerances. The bottom of widened entry area 47 of guide track 32 leads into upper vertical portion 48 of guide track 32.

Upper vertical portion 48 of guide track 32 is located vertically above and at least slightly horizontally rearward of the center of support roller 34. As described below and illustrated in FIGS. 10 and 11, this arrangement permits a dispensing roll 42 to fall by gravity from upper vertical portion 48 to lower vertical portion 50, via curved central portion 49.

Curved central portion 49 is an arcuate track section with the origin of the track section radius located substantially coaxial with support roller 34. This arcuate shape of central portion 49 minimizes the necessary space required for the roll supporting and transfer mechanism as dispensing roll 42 travels from upper vertical portion 48 to lower vertical portion 50. As shown by angle to in FIG. 4, the roll is guided along arcuate central portion 49 for a path of approximately 90°.

Figure 11:
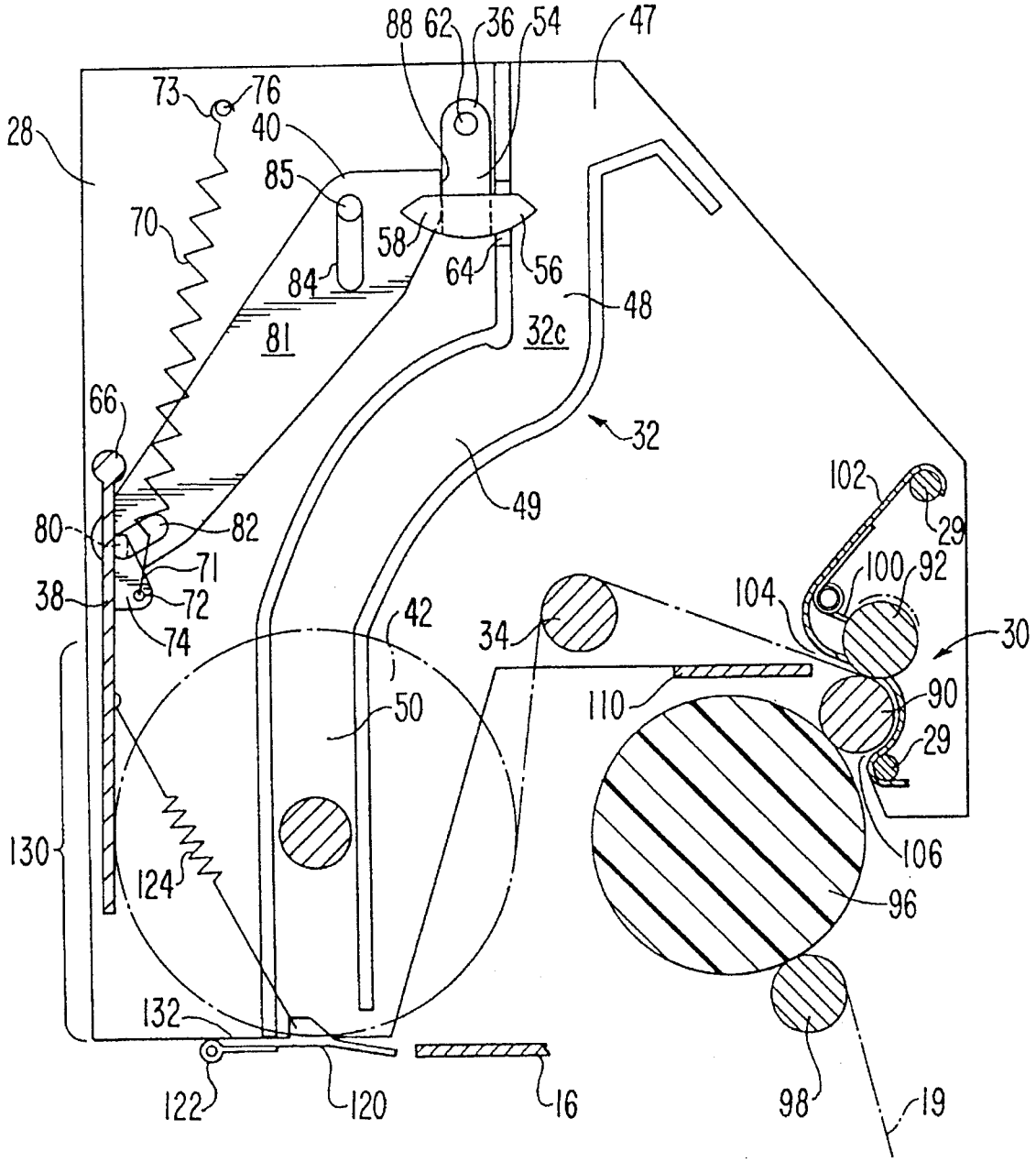
FIG. 11 is a side view, partially broken away and partially in section, of the roll dispenser of FIG. 2, showing the dispensing roll in a second partially depleted state during operation of the dispenser.
Figure 12:
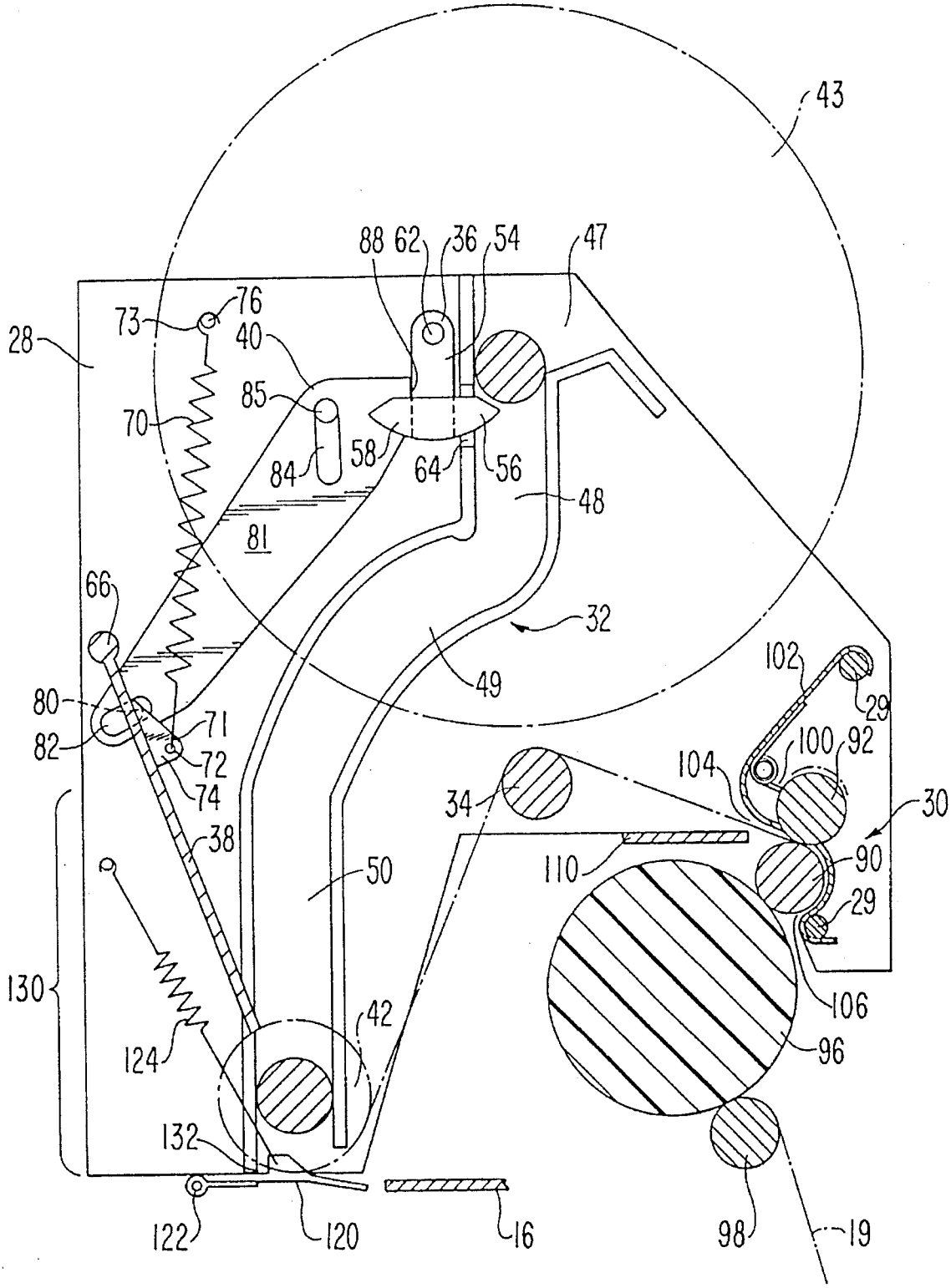
FIG. 12 is a side view, partially broken away and partially in section, of the roll dispenser of FIG. 2, showing the dispensing roll in a third partially depleted state and a second or reserve roll in a reserve position during operation of the dispenser.
Figure 13:
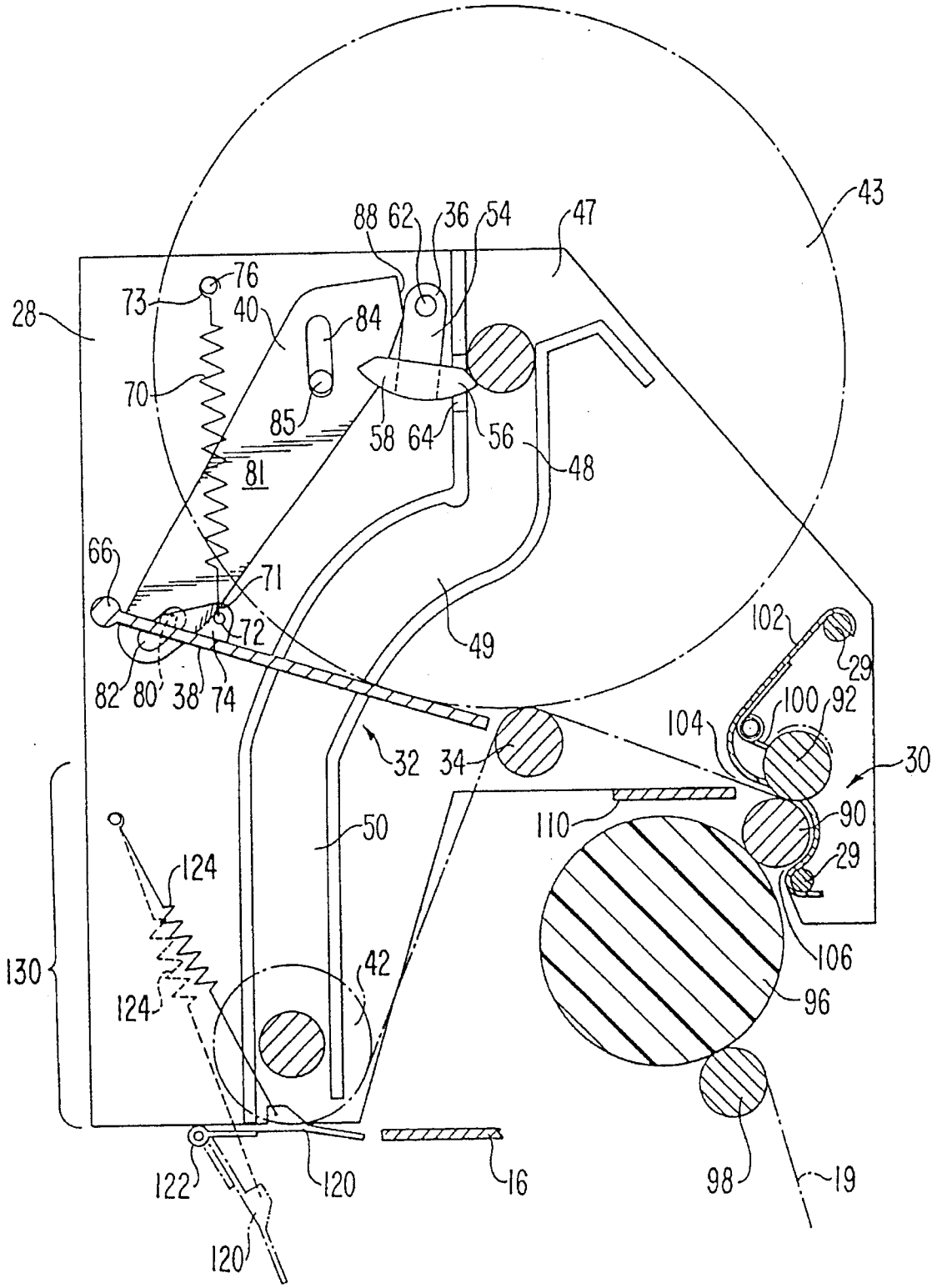
FIG. 13 is a side view, partially broken away and partially in section, of the roll dispenser of FIG. 2, showing the dispensing roll in a fourth partially depleted state and the second or reserve roll in an initial dispensing state during operation of the dispenser.
Figure 15:
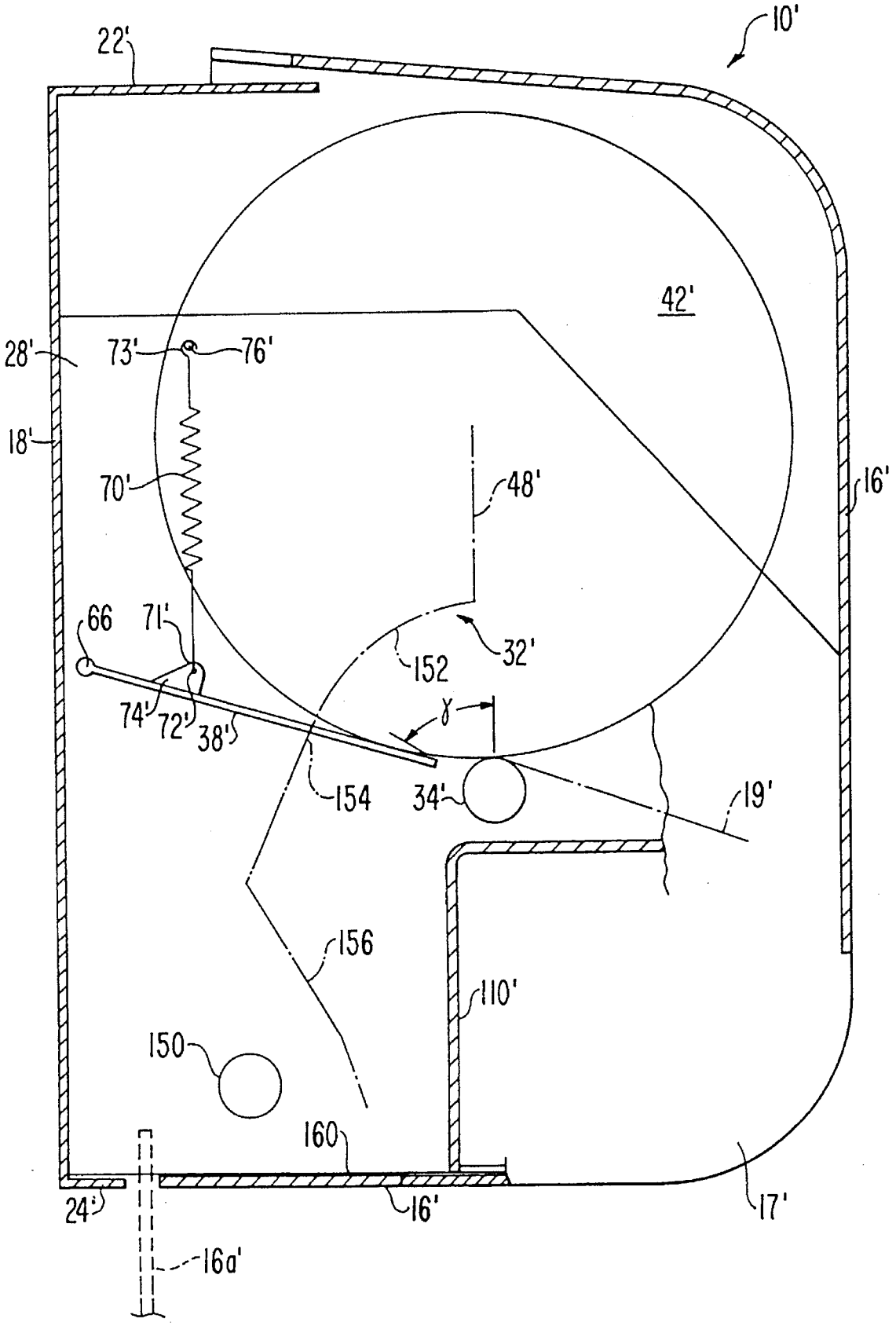
FIG. 15 is a side view, partially broken away and partially in section, of a roll dispenser having a roll supporting and transfer mechanism according to a second embodiment, schematically illustrating a dispensing roll in an initial dispensing state during operation of the dispenser.

As shown in FIGS. 11–13, after dispensing roll 42 falls by gravity into lower vertical portion 50, the core ends of dispensing roll 42 remain in lower vertical portion 50 with the bottom periphery of dispensing roll 42 supported by floor surface 132 and dropout door 120, until dispensing roll 42 has been entirely depleted and the core is either removed from dispenser 10, or knocked out through dropout door 120 as a reduced diameter dispensing roll drops into space 50.

Figure 10:
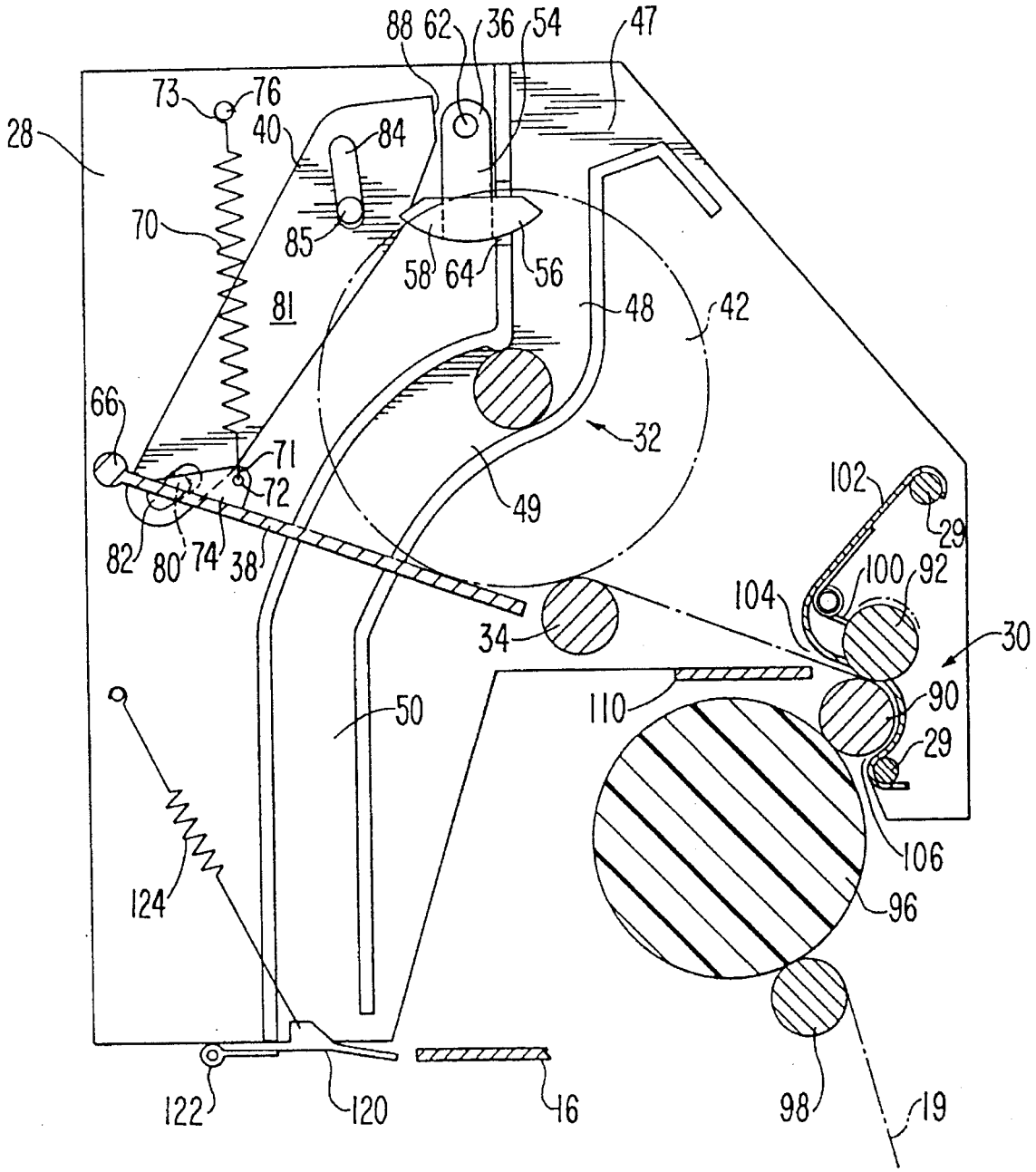
FIG. 10 is a side view, partially broken away and partially in section, of the roll dispenser of FIG. 2, showing the dispensing roll in a first partially depleted state during operation of the dispenser.

Support roller 34 supports dispensing roll 42 while it is being dispensed and is travelling downward through the upper vertical track portion 48. Support roller 34 extends across the width of internal housing 13 and is rotatably mounted with respect to side plates 28 by conventional hardware well known for accomplishing such a result. For example, a fixed rod could extend through holes 52 in each side plate 28 and be attached at its ends to the outside of side plates 28. Support roller 34 would then correspondingly include a hollow interior and be concentrically mounted around the fixed rod for rotation with respect thereto. As best shown in FIGS. 2 and 10, support roller 34 supports dispensing roll 42 by the roll periphery and not by the core ends. It is recognized that a smooth bar, a belt, or other structure may be used in lieu of support roller 34 to support dispensing roll 42 in a similar manner.

Figure 9:
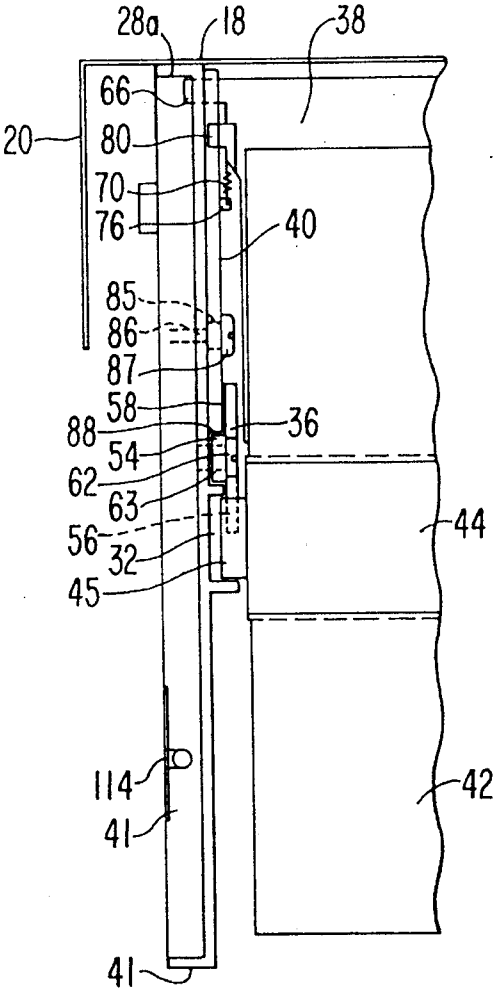
FIG. 9 is a horizontal cross-sectional view through the left side of the roll transfer and supporting mechanism when a reserve roll is supported in its reserve portion.
Figure 6:
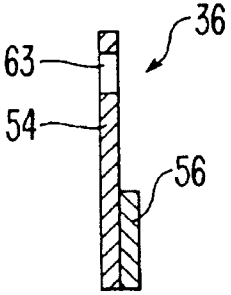
FIG. 6 is a cross-sectional view of the reserve roll support taken through line 6—6 of FIG. 5.
Figure 5:
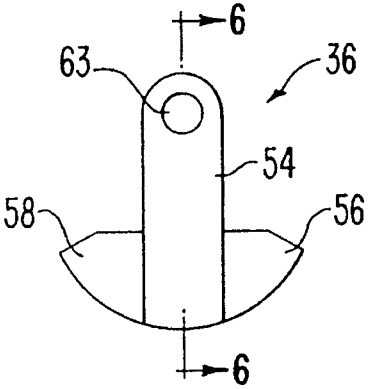
FIG. 5 is an elevational view of the reserve roll support.

As depicted in FIGS. 2, 5, and 6, reserve roll support 36 is anchor-shaped and includes a vertical portion 54 and front and rear holding projections 56 and 58 extending from the bottom of vertical potion 54. As shown in FIGS. 5, 6, and 9, holding projections 56 and 58 are horizontally offset from the vertical portion 54 to enable transfer link 40 to contact vertical portion 54 without contacting holding projections 56 and 58.

Each reserve roll support 36 is pivotally attached to a hole 60 in a respective side plate 28 by a conventional fastening arrangement, e.g., a screw 62, which penetrates through a hole 63 located in vertical portion 54. Screw 62 creates a pivot axis for reserve roll support 36 adjacent the upper end of guide track 32. A slot 64 located in the rear guide surface 32*b* of upper vertical portion 48, adjacent the bottom of reserve roll support 36, permits front holding projection 56 to pivot into, and out of, guide track channel 32*c*. Once installed, rear holding projection 58 serves no function, however, its existence enables reserve roll supports of the same design to be attached to both side plates 28*a* and 28*b*.

Reserve roll support 36 can be in either (i) a locked mode or state or (ii) a freely pivoting mode or state. In the locked mode, front holding projection 56 of reserve roll support 36 extends into, and is locked within, guide channel 32*c* for supporting a reserve roll by its core ends 45 and 46 above support roller 34. In the freely pivoting mode, front holding projection 56 of reserve roll support 36 is freely pivotal into, and out of, guide channel 32*c* and permits a reserve roll 43 to travel down upper vertical portion 48 of guide track 32. The mode of reserve roll support 36 depends on the position of sensor plate 38.

Figure 7:
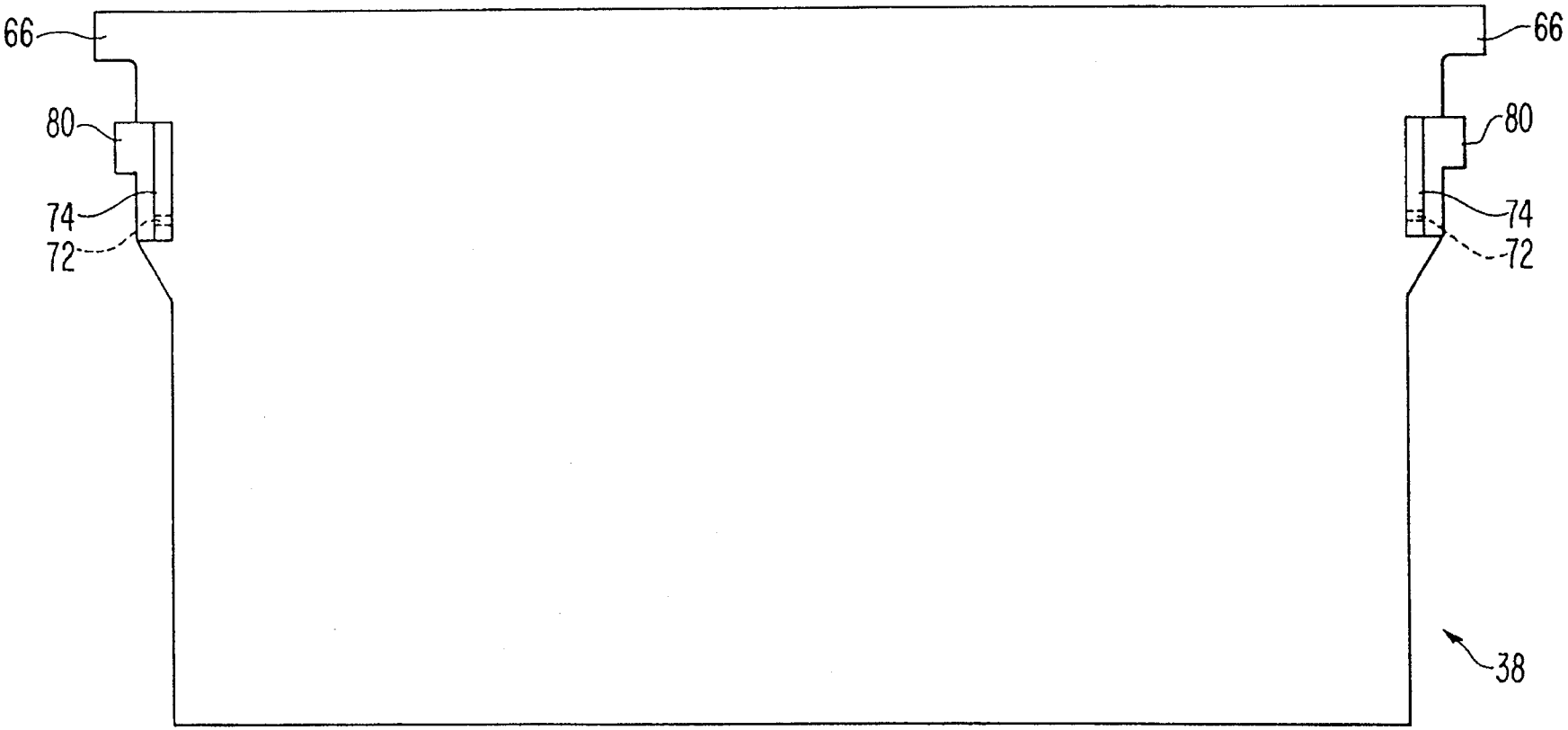
FIG. 7 is a top plan view of the sensor plate.

Sensor plate 38 extends along the rear of housing 13 between the side plates 28. As depicted in FIG. 7, sensor plate 38 includes a pair of outwardly projecting coaxial pivot pins 66 which extend into a sensor plate pivot hole 68 on each side plate 28. This arrangement pivotally connects sensor plate 38 to side plates 28 about a fixed axis. Sensor plate 38 is movable between a releasing or upper position, as shown in FIGS. 2, 10 and 13, and a range of retaining or lower positions, as shown in FIGS. 11 and 12.

A spring 70 is attached at its ends to sensor plate 38 and a side plate 28, to bias sensor plate 38 toward its upper position. Lower end of spring 70 includes a hook 71 which is inserted through a hole 72 in an upstanding portion 74 of sensor plate 38 adjacent its side edge. Upper end of spring 70 includes a hook 73 which is fastened to an inwardly projecting pin or screw 76 affixed to the inside of side plate 28. While one spring 70 may be sufficient to bias sensor plate 38 toward its first position, it is preferable to have a spring 70 attached to each end of sensor plate 38 to provide a more balanced biasing force. Springs 70 should preferably not be tighter than the minimum necessary to lift sensor plate 38 to its upper position, to minimize braking action on a dispensing roll in a dropped position. Sensor plate 38 further includes transfer link control pins 80 for interfacing with transfer link 40 so that the position of sensor plate 38 can control the mode of reserve roll support 36.

Each transfer link 40 is functionally coupled to one side of sensor plate 38 and to a respective reserve roll support 36 permitting the position of sensor plate 38 to operatively control the mode of reserve roll support 36. Transfer links 40 maintain reserve roll supports 36 in the freely pivotal mode when sensing plate 38 is in its upper position, and in the locked mode when sensor plate 38 is in one of its lower positions.

Figure 8:
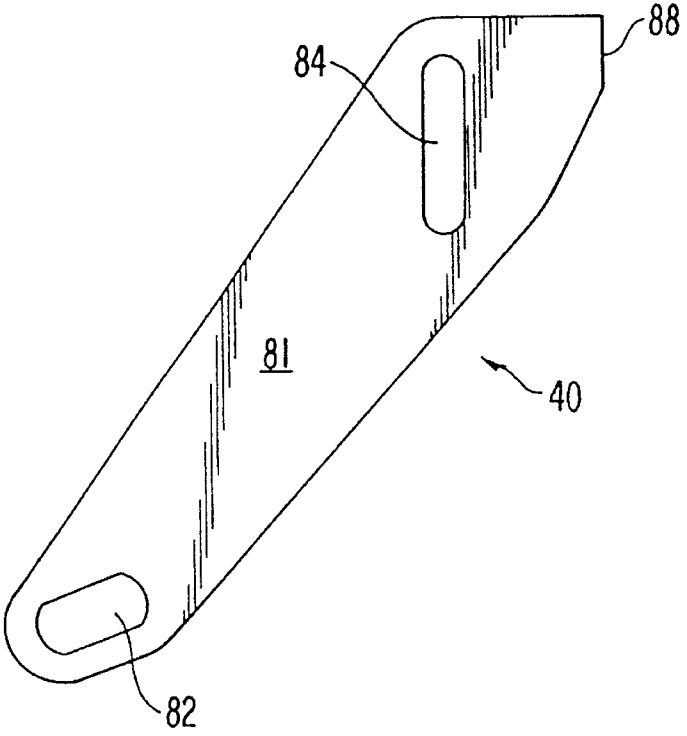
FIG. 8 is an elevational view of the transfer link.

As shown in FIG. 8, transfer link 40 includes a body 81 with a sensor plate interface slot 82 and a side wall pin interface slot 84 formed therein. A shoulder bolt or transfer link guide pin 85 extends from each side plate 28 attaching transfer link 40 to its respective side plate 28 and permitting relative movement therebetween. Transfer link guide pin 85 has a narrow body portion 86 which is narrower than side wall pin interface slot 84 permitting transfer link 40 to move with respect to its respective side wall 28. Further, transfer link guide pin 85 includes a widened head portion 87 preventing transfer link 40 from moving inwardly away from its respective side wall 28.

Control pins 80 at each side of sensor plate 38 travel within sensor plate interface slot 82 of their respective transfer link 40. Transfer link 40 further includes a forwardly extending edge 88 for contacting vertical portion 54 of reserve roll support 36, and urging reserve roll support 36 into its locked mode. Sensor plate 38 is thereby coupled to reserve roll support 36 via pins 80 and 85 and transfer links 40 to control the mode of reserve roll supports 36 according to the diameter of dispensing roll 42, as sensed by sensor plate 38. Further, the arrangement of pins 80 and 85 and the slots 82 and 84 on transfer links 40 prevents the upward travel of sensor plate 38 past its upper position. The operation of the roll transfer and supporting system will be described in detail hereinafter.

Dispenser 10 dispenses sheet material through a dispensing mechanism 30 which is located near opening 17 in cover 16. Dispensing mechanism 30 includes a pinch roller 90, a plurality of transfer rollers 92 mounted for rotation on a common shaft 94, a feed roller 96, and an exit roller 98. As shown in FIG. 2, the web of sheet material from dispensing roll 42 travels from the roll 42 between the transfer rollers 92 and pinch roller 90, around the feed roller 96, between the feed roller 96 and exit roller 98, and out of the dispenser 10 via opening 17.

As shown in FIGS. 2 and 3, transfer rollers 92 are spaced across the width of dispenser 10. In a preferred embodiment, two transfer rollers 92 are used. A spring 100 biases common shaft 94 toward pinch roller 90. This permits transfer rollers 92 to urge sheet material from dispensing roll 42 into contact with pinch roller 90 and transfer rollers 92 to be driven by pinch roller 90. As shown in FIG. 4, each side plate 28 includes a slot 99, which common shaft 94 extends through, to permit the effective biasing of shaft 94 by spring 100. Each side plate 28 further includes a spring mounting hole 101 for mounting each spring 100 to a respective side plate 28 by conventional hardware. While only one spring 100 is shown in FIG. 3, it is recognized that a spring may be used on each side of shaft 94 to provide a more balanced biasing force.

A cross-member 102 also extends across the width of dispenser 10 and is shaped to hook around and be secured by two front spacer supports 29. Cross-member 102 includes a loading entrance 104, a curved lower exit 106, and an access hole 108. Loading entrance 104 has a curved entry surface to guide the forward end of the sheet material 19 between transfer rollers 92 and pinch roller 90. Curved lower exit 106 guides the sheet material 19 toward the region between pinch roller 90 and feed roller 96. Access hole 108 is a centrally located hole in cross member 102 and permits maintenance personnel to note the position of the web and access a dispensing roll therethrough.

Exit roller 98 is located below feed roller 96 and preferably includes a stripper bar, not shown, placed adjacent to both the feed and exit rollers. A cutting mechanism, such as disclosed in U.S. Pat. No. 4,307,638 to DeLuca and Jespersen, which is hereby incorporated by reference, can also be incorporated in feed roller 96.

Feed roller 96 is surrounded by shield 110 which extends from an area adjacent exit roller 98 and below feed roller 96, horizontally rearward below feed roller 96, upwardly behind feed roller 96, and horizontally above feed roller 96, to a location adjacent the intersection of transfer rollers 92 and pinch roller 90. Shield 110 in the area adjacent feed roller 96 and transfer rollers 92 prevents contact of sheet material from dispensing roll 42 with feed roller 96 prior to the transfer rollers 92 urging the sheet material into contact with feed roller 90. In turn, this prevents jamming of the dispensing mechanism, by obstructing a loop of material, which may be formed due to overspin, from contacting feed roller 96. Additional details of certain aspects of the dispensing mechanism 30 are disclosed in U.S. Pat. No. 4,944,466 to Jespersen, which has been incorporated herein by reference.

While there may be numerous methods of assembling dispensing mechanism 30 and attaching it to dispenser 10, for ease of assembly, it is preferable that at least part of dispensing mechanism 30 is a separate assembly which can be mounted to side plates 28 as a single unit. In one preferred arrangement, pinch roller 90, feed roller 96, exit roller 98, and shield 110 are part of a separate assembly which can be mounted to side plates 28 via horizontal holes 112 located in side plates 28 and/or vertical holes 114 located in horizontal strengthening rib 41 on side plate 28.

Dispenser 10 also includes an arrangement for removing the cores 44 of depleted rolls from the dispenser. One preferred arrangement includes a roll dropout door 120 pivotally attached to bottom wall 24 of back plate assembly 12 by a hinge 122 or another conventional arrangement for providing pivotal movement. As shown in FIG. 13, roll dropout door 120 is movable between a closed position, shown in solid line, for retaining a roll core 44 within dispenser 10, and an open position, shown in phantom line, for permitting a roll core 44 from a depleted roll to fall out of the bottom of dispenser 10 by gravity. A spring 124 is attached at one end to dropout door 120 and at the other end preferably to the inside of sidewalls 20 of back plate assembly 14 biasing dropout door 120 into its closed position. Thus, dropout door 120 is either opened by maintenance personnel or is knocked open as reduced diameter dispensing roll drops into space 50, and the roll core drops out of dispenser 10.

A second preferred arrangement for removing depleted roll cores is shown in FIGS. 15–19 and described hereinafter with a second preferred embodiment of the roll transfer and supporting mechanism. However, it is recognized that this second arrangement for removing depleted roll cores could also be utilized with the roll transfer and supporting mechanism shown in FIGS. 2 and 10–13 with minor modifications.

FIGS. 2 and 10–13 show the chronology of loading and dispensing of rolls flexible sheet material from dispenser 10. Initially, cover 16 is opened and a dispensing roll 42 is loaded into dispenser 10 by depositing circular projections 45 and 46 of a properly oriented roll 42 into widened entry area 47 of guide tracks 32. Dispensing roll 42 moves downward due to gravity and its projections 45 and 46 move into upper vertical portion 48 at guide tracks 32.

Sensor plate 38 is located in its releasing position due to the biasing by spring 70. As seen in FIG. 2, transfer link control pins 80 of sensor plate 38 are located in the upper portion of their respective slot 82, and transfer link guide pins 85 of side plates 28 are located near the lower portion of their respective slot 84. Thus, transfer links 40 will be in their upper position out of contact with reserve roll supports 36, and thus reserve roll supports 36 will be in their freely pivotal mode.

As dispensing roll 42 moves downward due to gravity, projections 45 and 46 contact front holding projections 56 and the weight of dispensing roll 42 forces reserve roll supports 36 in their freely pivotal mode to pivot out of channels 32. Roll 42 continues to move downwardly under the guidance of the circular projections 45 and 46 within channels **32*c* until the outer surface of dispensing roll 42 contacts support roller 34, as shown in FIG. 2. At this point, sensor plate 38 continues to remain in its spring biased first position. Sensor plate 38, via transfer links 40, continues to maintain reserve roll supports 36** in their freely pivotal mode.

A towel web of sheet material 19 from dispensing roll 42 is then fed forward by maintenance personnel towards pinch roller 90. Access hole 108 in cross member 102 allows maintenance personnel to note the position of the web. The web is thread around rollers 90, 96 and 98 and out the mechanism by a feedwheel, not shown, on feed roller 96. Cover 16 is then closed and flexible sheet material 19 from dispensing roll 42 can then be dispensed through opening 17 by a user.

As sheets from dispensing roll 42 are dispensed, dispensing roll 42 diminishes in size and the distance between the dispensing roll core 44 and support roller 34 decreases, and the projections 45 and 46 from dispensing roll core 44 move downward along upper vertical portion 48 of guide tracks 32.

Immediately prior to dispensing roll 42 reaching a first predetermined diameter, the core 44 of dispensing roll 42 is adjacent the bottom of upper vertical portion 48. The depletion of a few additional sheets of material from roll 42 causes projections 45 and 46 to reach the bottom of upper vertical portion 48 as shown in FIG. 10. Rear guide surface **32*b* no longer prevents the projections 45 and 46 from moving rearwardly with respect to support roller 34. Due to the positioning of roll 42 with respect to the support roller 34 and the forces of gravity, roll 42 moves off of support roller 34, with projections 45 and 46 being guided along curved central portions 49 of guide tracks 32. Roll 42 continues to fall into lower vertical portion 50 of guide track 32 within a lower dispensing area 130 of dispenser 10, as shown in FIG. 11. In lower dispensing area 130, dispensing roll 42 is supported by a supporting floor surface 132 including dropout door 120. In the second embodiment as described hereinafter and shown in FIGS. 15–19, dispensing roll 42 is supported by a second dispensing roller when it falls off of support roller 34**.

As projections 45 and 46 move from upper vertical portion 48 into the lower vertical portion 50, the outside surface of roll 42 contacts sensor plate 38 and the weight of roll 42 pushes sensor plate 38 against its spring biasing force. This moves transfer link control pins 80 against the lower end of their respective sensor plate interface slot 82. As roll 42 continues to fall, the force applied against lower end of interface slots 82 by control pins 80 moves transfer link 40 downward with respect to transfer link guide pins 85, until transfer link guide pins 85 are located in the upper portions of their respective side plate interface slot 84. Sensor plate 38 is now in its retaining position in nearly parallel alignment with back wall 18, and forwardly extending edges 88 of transfer links 40 abut and move reserve roll supports 36 into their locked mode forcing and locking retaining projections 56 into channels **32*c* of guide tracks 32. This permits a full second or reserve roll 43 to be loaded into dispenser 10 and be supported above the support roller 34 by reserve roll supports 36**.

At any point with sensor plate 38 in a retaining position, e.g., as shown in FIGS. 10 and 11, a reserve roll 43 may be deposited into dispenser 10 in the same manner described above for the loading of dispensing roll 42. Reserve roll 43 first travels from widened entry area 47 to upper vertical portion 48. As reserve roll 43 travels down upper vertical portion 48, retaining projections 56, which are locked within channels **32*c*, support projections 45 and 46 of reserve roll 43 to retain reserve roll 43 at a reserve position above support roller 34**.

Material from dispensing roll 42 continues to be dispensed in the lower housing portion 130 while sensor plate 38 is held open by the periphery of dispensing roll 42. FIG. 12 shows the situation in which dispensing roll 42 is nearly depleted so that sensor plate 38 has moved upwards but has not entirely cleared dispensing roll 42. Control pins 80 have moved upwards within slots 82, but since control pins 80 have not yet contacted the upper ends of slots 82, transfer links 40 have not yet moved out of abutment with reserve roll supports 34. As long as there is enough sheet material wound on core 44 of dispensing roll 42 to prevent sensor plate 38 from clearing it, reserve roll 43 will remain in the reserve position held by projections 56.

When dispensing roll 42 reaches a second predetermined reduced diameter, dispensing roll 42 is too small to hold the sensor plate 38 in a retaining position and the sensor plate 38 moves into the releasing position due to its spring biasing. When sensor plate 38 moves upward into its releasing position, it unlocks the reserve roll supports 36 changing them into their freely pivotal mode. Front holding projections 56 rotate out of channels **32*c* in guide tracks 32, allowing reserve roll 43 to drop down upper vertical portion 48 onto support roller 34. It is preferable that when dispensing roll 42** reaches its second predetermined diameter, only a few sheets of material are left on the roll.

Upon falling, reserve roll 43 is supported on support roller 34 on top of the remainder of the flexible sheet material from dispensing roll 42, without its core being supported by projections 56. The action of the remaining flexible sheet material from dispensing roll 42 being fed through dispensing mechanism 30 automatically threads the forward edge of the flexible sheet material from reserve roll 43 through dispensing mechanism 30. Two-plies of sheet material will continue to be dispensed until the remaining sheet material from dispensing roll 42 is completely depleted. Thus, dispensing the final sheets from the initial dispensing roll automatically routes the sheets from the new dispensing roll through the feed, pinch, and exit rollers. Further, once sheet material from reserve roll 43 is thread through dispensing mechanism 30, it becomes a dispensing roll behaving in a manner similar to roll 42. Depleted roll cores can be removed from dispenser 10 by simply pivoting dropout door 120 and permitting the depleted core to fall out of the dispenser by gravity.

Dispenser 10 thus automatically transfers a new full roll of sheet material into a position for dispensing after substantially all the sheet material has been dispensed from an initial dispensing roll, and automatically initiates the feeding of sheet material from the second roll. Furthermore, dispenser 10 accomplishes this automatic transfer and feeding initiation in a manner that reduces the likelihood of jamming dispensing mechanism 30. The location of shield 110 and cross member 102 in the area between support roller 34 and the rollers 90, 92, 96, and 98 of dispensing mechanism 30 prevents a loop of material which may occur because of overspin, from contacting the rollers of dispensing mechanism 30.

Dispenser 10 is not significantly larger than single roll dispensers, as single roll dispensers typically utilize a dispensing mechanism spaced from the dispensing roll. However, dispenser 10 effectively utilizes the space behind dispensing mechanism 30 to permit the storage of a full diameter reserve roll while a one-half diameter roll is being dispensed. The effective space within dispenser 10 is further maximized by utilizing an arcuate central track portion whose path is radially spaced from support roller 34. As dispenser 10 can contain a reserve roll during the dispensing of a dispensing roll, rolls can be fully depleted without leaving users without paper towels. The area behind dispensing mechanism 30 is sized to cooperate with the location of arcuate portion 49 of guide tracks 32 and the location of support roller 34, so that preferably, approximately 25% of the material remains on roll 42, when roll 42 falls off of support roller 34 into lower housing portion 130.

FIGS. 15–19 are similar to FIGS. 2 and 10–13, and show the second preferred embodiment of the roll transfer and supporting mechanism in dispenser 10', and the chronology of loading and dispensing of rolls of flexible sheet material therein. Elements of dispenser 10' which are similar to elements of dispenser 10 will be indicated by like-primed numerals.

The second embodiment of the roll transfer and supporting mechanism primarily differs from the first embodiment by the shape of the lower portion of guide track 32' and the use of an additional support roller 150. However, while there may be other minor proportional differences between the embodiments, in essentially most other aspects, the second embodiment of the roll transfer and supporting mechanism is similar to the first embodiment.

Guide track 32' is schematically depicted by its center line, and that guide track 32' is formed in a similar manner as guide track 32, i.e., it includes opposing guide surfaces and a channel therebetween. In lieu of curved central portion 49 and lower vertical portion 50, guide track 32' includes a shorter curved central portion 152, a downwardly and rearwardly extending portion 154, and a downwardly and forwardly extending portion 156. The junction between rearwardly extending portion 154 and forwardly extending portion 156 is located vertically above second support roller 150.

Curved control portion 152 forms a path for the projections of the curve end which is radially spaced from support roller 34'. A dispensing roll travels along curved central portion 152 for an angle $\gamma$, which is approximately 60°.

Second support roller 150 is preferably similar to support roller 34' with respect to its characteristics, function, and mounting arrangement. However, second support roller 150 is positioned to support dispensing roll 42' at a second location, substantially within lower dispensing area 130'.

A second arrangement is shown for removing depleted cores from dispenser 10'. In lieu of a roll dropout door, the bottom of cover 16' extends further back toward the back plate assembly 14' and bottom wall 24' has been shortened. As will become evident from FIG. 19 and the description of the operation of dispenser 10', depleted roll cores are supported on the bottom floor 160 of cover 16'. Upon opening cover 16', an empty core will drop into cover 16' for easy removal by maintenance personnel. It is recognized that an arrangement for removing roll cores with a dropout door could also be utilized with the roll transfer and supporting mechanism shown in FIGS. 15–19 with minor modifications.

Figure 17:
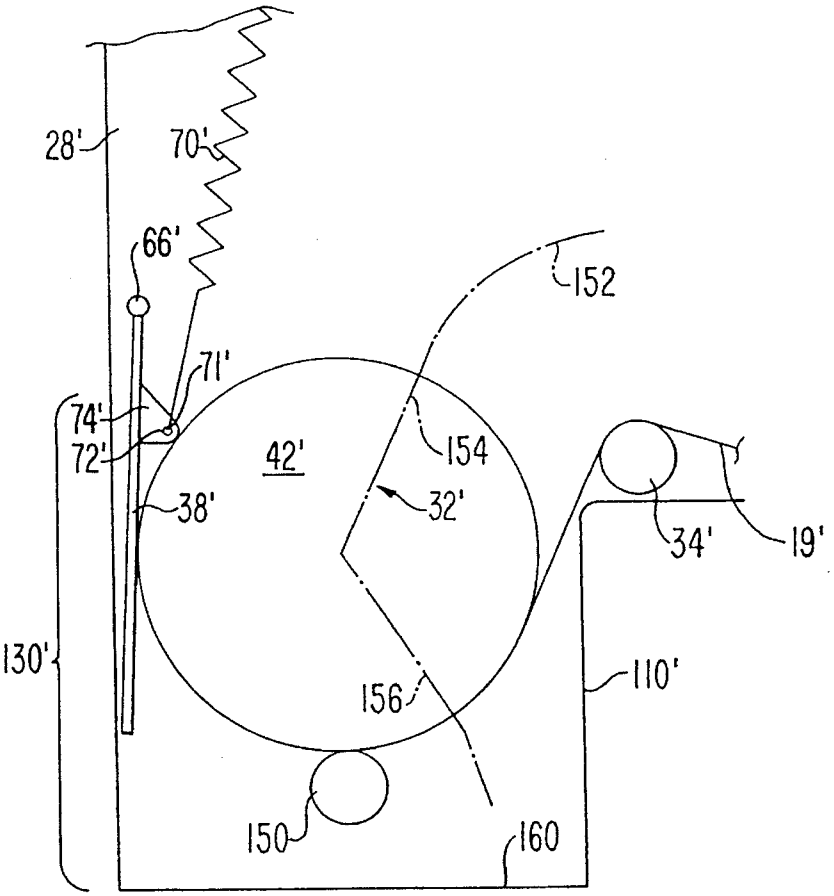
FIG. 17 is a side view, partially broken away and partially in section, of the roll dispenser of FIG. 15, schematically showing the dispensing roll in a second partially depleted state during operation of the dispenser.
Figure 16:
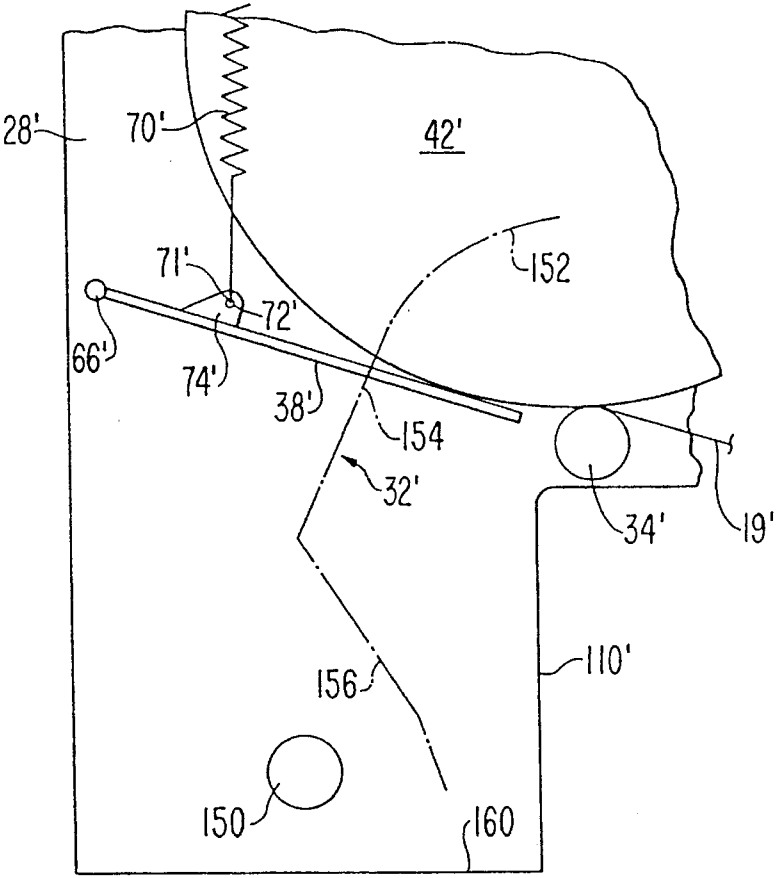
FIG. 16 is a side view, partially broken away and partially in section, of the roll dispenser of FIG. 15, schematically illustrating the dispensing roll in a first partially depleted state during operation of the dispenser.

Operation of dispenser 10' is substantially identical to the operation of dispenser 10 from the initial insertion of a first dispensing roll 42' into dispenser 10' until dispensing roll 42' reaches the predetermined diameter at which it falls downwardly from support roller 34'. Upon falling from support roller 34', dispensing roll 42' travels downward to be supported by second support roller 150, with the projections of its core, not shown, guided in curved central portion 152 and rearwardly extending portion 154. In a manner similar to the first embodiment, the outside surface of dispensing roll 42' contacts sensor plate 38' to move it from a releasing position to a retaining position, as shown in FIGS. 16 and 17. Similarly, this causes reserve roll supports, not shown, to move from their freely pivotal mode to their locked mode, due to the transfer links, guide pins, and control pins, not shown. With reserve roll supports in their locked mode, a reserve roll 43' may be loaded into dispenser.

While supported on second support roller 150, dispensing roll 42' will continue to be depleted until it reaches a predetermined diameter which permits it to fail off of second support roller 150 and provides sufficient clearance for sensor plate 38' to move into its releasing position under its spring bias. Dispensing roll 42' preferably only has a few sheets remaining when it reaches this predetermined diameter.

Figure 19:
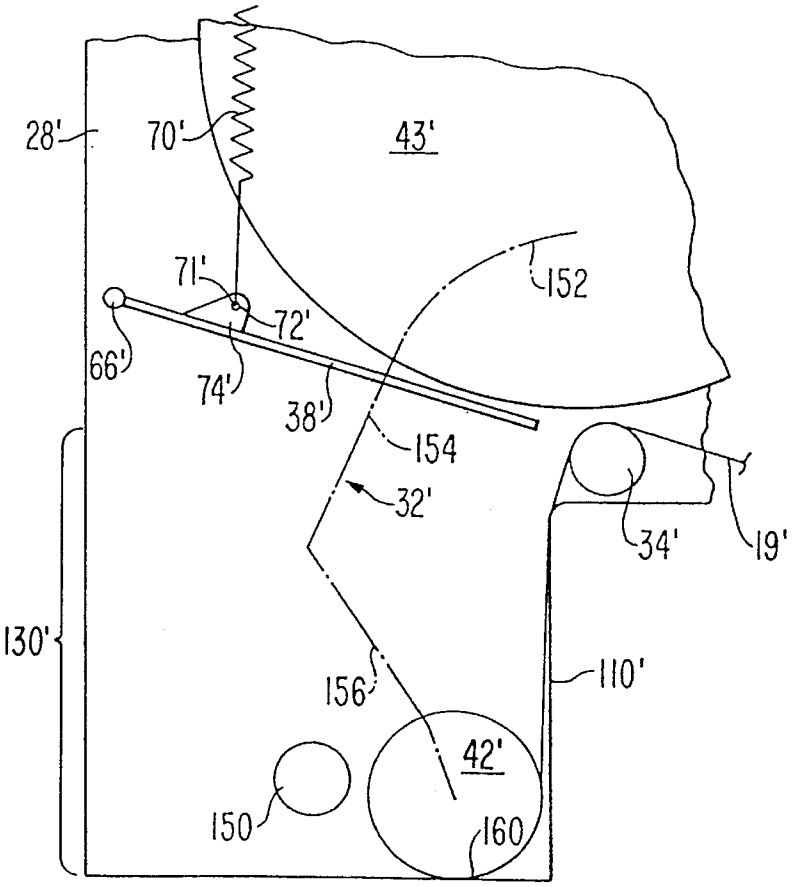
FIG. 19 is a side view, partially broken away and partially in section, of the roll dispenser of FIG. 15, schematically showing the dispensing roll in a fourth partially depleted state and a second or reserve roll in an initial dispensing state during operation of the dispenser.
Figure 18:
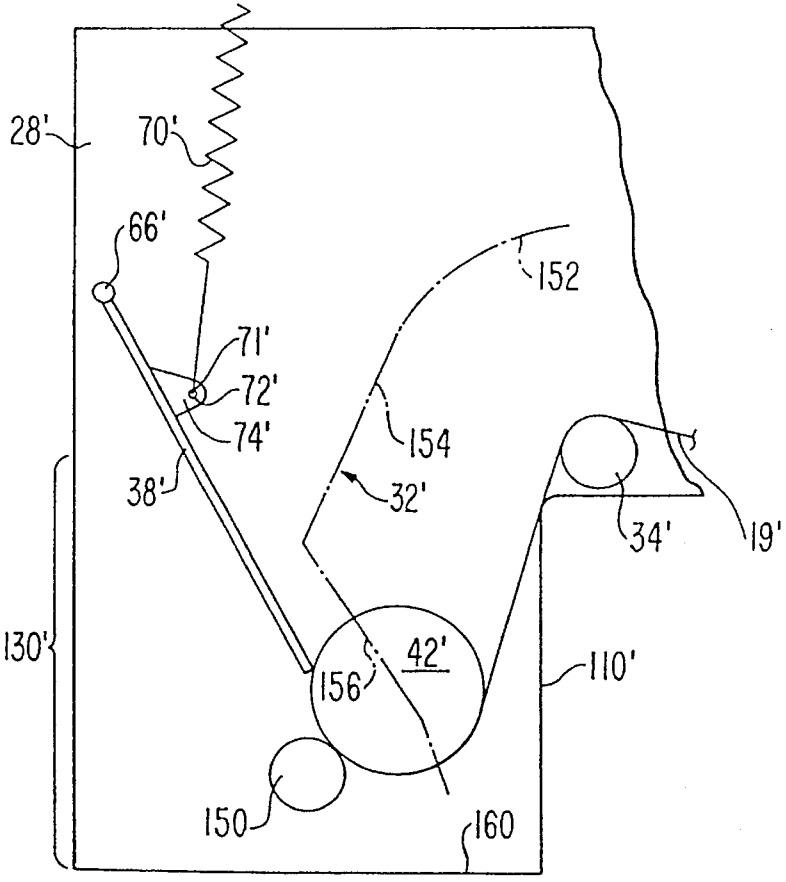
FIG. 18 is a side view, partially broken away and partially in section, of the roll dispenser of FIG. 15, schematically illustrating the dispensing roll in a third partially depleted state during operation of the dispenser.

As shown in FIGS. 18 and 19, dispensing roll 42' fails from a position supported on second support roller 150 to a position supported on the bottom floor 160 at cover 16' upon reaching the predetermined diameter. As dispensing roll 42' fails, its core is guided by forwardly extending portion 156 of guide track 32'. As with the first embodiment, the moving of sensor plate 38' from a lower position to its upper position places reserve roll supports, not shown, in their freely pivotal mode. This causes a reserve roll 43' supported at projections of its core by reserve roll supports to fall to a position supported at its periphery by support roller 34'.

Continued dispensing of dispensing roll 42' automatically threads sheet material from reserve roll 43' through the dispensing mechanism. Upon deletion of dispensing roll 42', its depleted core remains on bottom floor 160 until cover 16' is opened and the core is removed as previously described. The spacing of second support roller 150 and bottom floor 160 prevents a depleted roll core on floor 160 from interfering with the dispensing of a roll supported on second support roller 150.

The invention has been described in detail in connection with preferred embodiments. The preferred embodiments, however, are merely for example only and this invention is not restricted thereto. It would be easily understood by those skilled in the art that variations and modifications can be easily made within this scope of this invention as defined by the appended claims.

I claim:

1. A dispenser for rolls of flexible sheet material wound on cores, the cores having ends extending beyond the sides of the rolls, the dispenser comprising:

a housing having opposite side walls, each side wall having a guide track for receiving and guiding the core ends;

a first support means in said housing for contacting and supporting a roll of flexible sheet material during a first portion of the dispensing of the sheet material from the dispenser;

a second support means for contacting and supporting a roll of flexible sheet material during a second portion of the dispensing of the sheet material from the dispenser, said second support means being located in said housing below said first support means;

a dispensing mechanism supported in said housing laterally of said first support means for dispensing sheet material from a dispensing roll out of said dispenser;

a reserve roll support pivotally attached to a side wall adjacent an upper portion of at least one of said guide tracks, said reserve roll support exhibiting first and second states; in said first state, said reserve roll support permitting a reserve roll of flexible sheet material at an upper reserve position to freely travel downward along said guide tracks and onto said first support means; and in said second state, at least a portion of said reserve roll support is located in said one guide track for retaining a reserve roll of flexible sheet material at an upper reserve position and preventing the reserve roll from travelling downward along said guide tracks and onto said first support means;

a sensing mechanism mounted in said housing and between said side walls for sensing the diameter of the dispensing roll as sheet material is dispensed from the dispensing roll during the support of the dispensing roll by both said first and second support means, said sensing mechanism being movable between at least one retaining position and at least one releasing position, said sensing mechanism being in a releasing position when the dispensing roll is supported by said first support means and has a diameter greater than a predetermined diameter, said sensing mechanism being in a retaining position when the dispensing roll is supported by said second support means and has a diameter less than the predetermined diameter; and a coupling device coupled to said sensing mechanism and to said reserve roll support, said coupling device placing said reserve roll support into said first state when said sensing mechanism is in a releasing position, and said coupling device placing said reserve roll support into said second state when said sensing mechanism is in a retaining position.

2. A dispenser as recited in claim 1, said housing includes a lower storage area for holding a substantially depleted dispensing roll having only a length of sheet material remaining, said lower storage area being located in said housing with respect to said first support means so that the remaining length of sheet material from the roll in said lower storage area remains in contact with the first support means to thereby contact and simultaneously feed sheet material from a reserve roll which has been released from the upper reserve position.

3. A dispenser as recited in claim 1, further comprising a biasing member, said sensing mechanism includes a sensor plate pivotally supported in said housing, said biasing member biasing said sensor plate towards said at least one releasing position.

4. A dispenser as recited in claim 3, wherein said coupling device includes at least one connecting link structurally coupled to said sensor plate.

5. A dispenser as recited in claim 4, wherein said biasing member biases said sensor plate in an upward direction to move said at least one connecting link toward said reserve roll support as sheet material is dispensed from said dispensing roll, said at least one connecting link having an upper end adjacent said reserve roll support.

6. A dispenser as recited in claim 1, wherein said coupling device includes an upper end adjacent said reserve roll support, said reserve roll support further including an engagable surface facing said upper end of said coupling device, said engagable surface contacting said upper end of said reserve roll support when a reserve roll is supported in said upper reserve position.

7. A dispenser as recited in claim 1, wherein said reserve roll support is freely pivotable in said first state.

8. A dispenser as recited in claim 1, further comprising two reserve roll supports and two coupling devices, each reserve roll support being pivotally attached to a respective side wail, said sensing mechanism includes a sensor plate pivotally supported in said housing with opposing ends pivotally mounted to a respective side wall, each said coupling device being structurally coupled to said sensor plate adjacent a respective opposing end of said sensor plate and to a respective reserve roll support.

9. A dispenser as recited in claim 1, wherein said dispensing mechanism includes a feed roller and means for urging sheet material from the dispensing roll into contact with said feed roller, and a shield disposed in said housing around said feed roller, said shield being located between said feed roller and a dispensing roll to prevent contact of the sheet material from the dispensing roll with the feed roller prior to said urging means urging the sheet material into contact with said feed roller.

10. A dispenser as recited in claim 1, wherein each said guide track includes opposing lateral guide track members forming a channel therebetween, one lateral guide track member of said one guide track including a slot located therein adjacent its upper end, said reserve roll support passing through said slot into the channel of said one guide track.

11. A dispenser as recited in claim 1, said guide tracks including a bottom portion, said dispenser further including a door vertically superimposed below said bottom portion of said guide tracks, said door being partially movable between a first closed position and a second open position, said door in said first closed position retaining a depleted roll within the dispenser, and said door in said second open position permitting a depleted roll within the dispenser to fall out of the dispenser by gravity.

12. A dispenser as recited in claim 1, said dispenser further comprising a cover pivotally attached to said housing, said cover having a floor surface for supporting a depleted roll core within said dispenser, said cover being movable between a dosed position retaining a depleted roll core within the dispenser and an open position permitting the removal of a depleted roll core from the dispenser.

13. A method for dispensing sheet material from a dispenser wherein the sheet material is wrapped in a roll about a core and the sheet material is dispensed from the dispenser through a dispensing mechanism, the method comprising the steps of:

supporting a first roll of the sheet material in the dispenser in a first supported position with the roll surface of the first roll in contact with a support means;

dispensing sheet material from the first roll through the dispensing mechanism to diminish the diameter of the first roll in the first supported position until the first roll reaches a first predetermined diameter;

guiding the first roll downward from the first supported position in contact with the support means to a second supported position upon the first roll reaching a first predetermined diameter so that a free end of its sheet material remains in contact with the support means and threaded through the dispensing mechanism;

activating a retaining mechanism in response to the first roll being guided from the first supported position to the second supported position;

loading a second roll into the dispensing mechanism;

supporting said second roll by the retaining mechanism in a reserve position out of contact with, and vertically above, the support means;

dispensing sheet material from the first roll through the dispensing mechanism to diminish the diameter of the first roll in the second supported position until the first roll reaches a second predetermined diameter;

deactivating said retaining mechanism in response to said first roll reaching the second predetermined diameter;

guiding the second roll downward from the reserve position to said first supported position supported by the support means, upon said retaining mechanism being deactivated; and dispensing sheet material from the second roll through the dispensing mechanism.

14. The method according to claim 13, further comprising the steps of:

sensing the diameter of the first roll while in the first supported position supported by and in contact with the support means;

sensing the diameter of the first roll while in the second supported position; and sensing the diameter of the second roll while in the first supported position supported by and in contact with the support means.

15. The method according to claim 13, further comprising the step of averting the activation of the retaining mechanism to prevent the second roll of the sheet material from being supported in said reserve position when the first roll is greater than the first predetermined diameter or less than the second predetermined diameter.

16. The method according to claim 13, further comprising the steps of:

simultaneously (i) dispensing sheet material from the first roll when said first roll has a diameter smaller than said second predetermined diameter, and (ii) initiating the dispensing of the sheet material from the second roll.

17. The method according to claim 13, said method further comprising the step of supporting said first roll by a floor surface of the dispenser when said first roll is in said second supported position.

18. The method of claim 13, said method further comprising the step of supporting said first roll by a second support means when said first roll is in said second supported position.

19. The method of claim 18, said method further comprising the step of guiding the first roll downward from the second supported position to a third supported position when the first roll reaches its second predetermined diameter.

20. The method of claim 19 said method further comprising the step of supporting said first roll by a floor surface of the dispenser when said first roll is in said third supported position.

21. The method of claim 19, said method further comprising the steps of:

guiding the second roll from the first supported position to the second supported position; and dispensing sheet material from the second roll in the second supported position while the first roll remains in the third supported position.

22. The method of claim 13, further comprising the steps of:

dispensing all of the sheet material from the first roll;

storing the depleted first roll inside the dispenser;

opening a door located in the bottom of the dispenser to automatically cause the depleted first roll to fall out of the dispenser.

23. The method of claim 13, further comprising the steps of:

dispensing all of the sheet material from the first roll;

storing the depleted first roll inside the dispenser;

pivotally opening a dispenser cover; and removing the depleted first roll from the dispenser.

24. The method of claim 13, wherein said guiding the first roll from the first supported position to the second supported position step includes the step of guiding the first roll along a radial path with the origin of the radial path being coaxial with the support means.

25. The method of claim 24, wherein said guiding the first roll from the first supported position to the second supported position step includes the step of guiding the first roll approximately 90° along said radial path.

26. A dispenser for rolls of flexible sheet material wound on cores, the cores having ends extending beyond the sides of the rolls, the dispenser comprising:

a housing having opposite side walls, each side wall having a guide track for receiving and guiding the core ends of a dispensing roll, each said guide track including an arcuate portion, said housing further having an upper portion and a lower portion;

a support member supported in said housing for contacting and supporting the dispensing roll during a portion of the dispensing of the sheet material from the dispensing roll, each said arcuate guide track portion having a path being substantially radially spaced from the support member; and a dispensing mechanism supported in said housing laterally of said support member for dispensing sheet material from the dispensing roll and out of said dispenser, said dispensing roll travels from the upper portion of the housing to the lower portion of the housing upon reaching a predetermined diameter, the core ends of the dispensing roll being guided in said arcuate portions of said guide track as said dispensing roll travels from the upper portion of the housing to the lower portion of the housing, said support member supporting the dispensing roll for at least a portion of its travels within said arcuate portions.

27. The dispenser of claim 26, each said guide track including a substantially vertical portion having upper and lower ends, each said arcuate portion having upper and lower ends, said lower end of each said vertical portion being coupled to the upper end of a respective arcuate portion to form a continuous guide track from the upper end of each vertical portion to the lower end of a respective arcuate portion.

28. The dispenser of claim 27, wherein each said substantially vertical portion is a first vertical portion, each said guide track further comprising a second substantially vertical portion located vertically below, and horizontally offset from, a respective first vertical portion, each said second vertical portion having upper and lower ends, said lower end of said arcuate portion being coupled to the upper end of a respective second vertical portion to form a continuous guide track from the upper end of each first vertical portion to the lower end of a respective second vertical portion.

29. The dispenser of claim 28, wherein an angle can be defined between the support member and the upper end of said arcuate portion, and the support member and the lower end of said arcuate portion, said angle being approximately 90°.

30. The dispenser of claim 27, wherein an angle can be defined between the support member and the upper end of said arcuate portion, and the support member and the lower end of said arcuate portion, said angle being in the range between 30°–60°.

31. The dispenser of claim 27, further comprising means for supporting a reserve roll above said support member, without contacting the support member, with its core ends located within a respective vertical portion.

32. A method for dispensing sheet material from a dispenser wherein the sheet material is wrapped in a roll about a core and the sheet material is dispensed from the dispenser through a dispensing mechanism, said method comprising:

supporting a first roll by a first supporting member;

dispensing a first amount of sheet material from said first roll while said first roll is being supported by said first supporting member;

permitting the first roll to fall by gravity from the first supporting member to a second supporting member upon the first roll reaching a first predetermined diameter;

supporting the first roll by the second supporting member;

dispensing a second amount of sheet material from said first roll while said first roll is being supported by said second supporting member;

permitting the first roll to fall by gravity from the second supporting member to a third supporting member upon the first roll reaching a second predetermined diameter, said second predetermined diameter being smaller than said first predetermined diameter;

supporting the first roll inside the dispenser by the third supporting member; and dispensing the remaining amount of sheet material from said first roll until the first roll is depleted.

33. The method of claim 32, further comprising the steps of:

locking a movable roll support in response to the first roll falling by gravity upon reaching the first predetermined diameter;

depositing a second roll into said dispenser;

supporting said second roll by said locked roll support at a position above said first supporting member;

unlocking said movable roll support and permitting the second roll to fall by gravity onto said first supporting member, in response to the first roll falling by gravity upon reaching the second predetermined diameter.

34. The method of claim 33, further comprising the step of:

automatically feeding sheet material from said second roll through the dispensing mechanism in response to said dispensing the remaining amount of sheet material from the first roll step.

35. A dispenser for rolls of flexible sheet material wound on cores, the cores having ends extending beyond the sides of the rolls, the dispenser comprising:

a housing having opposite side walls, each side wall having a guide track for receiving and guiding the core ends, said guide tracks having an upper end;

a support means supported in said housing adjacent said guide track for contacting a roll of flexible sheet material during a portion of the dispensing of the sheet material from the dispenser;

a dispensing mechanism supported in said housing laterally of said support means for dispensing sheet material from the dispensing roll out of said dispenser;

a reserve roll support pivotally attached to one side wall for movement about a pivot axis, said reserve roll support being movable between a first position in which a reserve roll of flexible sheet material can freely move downward along said guide tracks to be supported by said support means, and a second position located within the guide track of said one side wall for supporting a reserve roll of flexible sheet material at an upper reserve position above said support means, said pivot axis being located adjacent said upper end of the guide track of said one side wall; and a sensing mechanism for sensing the diameter of the dispensing roll and controlling the movement of the reserve roll support in accordance with the sensed diameter of the dispensing roll.

36. The dispenser of claim 35, said reserve roll support including a projection thereon, said reserve roll support being switchable between a locked mode and a freely pivotal mode, said projection extending into and locked within the guide track of said one side wall when said reserve roll support is in said locked mode, said projection being freely pivotal into and out of the guide track of said one side wall when said reserve roll support is in said freely pivotal mode.

37. The dispenser of claim 36, said sensing mechanism includes a sensing device and a coupling device, said sensing device mounted in said housing for sensing the diameter of the dispensing roll as sheet material is dispensed from the dispensing roll, said sensing device being movable between at least one retaining position and at least one releasing position, said sensing device being located in a releasing position when the diameter of the dispensing roll is greater than a first predetermined diameter, said sensing device being located in a retaining position when the diameter of the dispensing roll is greater than a second predetermined diameter and less than the first predetermined diameter, said sensing mechanism being located in a releasing position when the diameter of the dispensing roll is smaller than the second predetermined diameter; said coupling device coupled to said sensing device and said reserve roll support, said coupling device being movable between a first position placing said reserve roll support into said freely pivotal mode and a second position placing said reserve roll support into said locked mode; said coupling device being in said first position when said sensing device is in a releasing position and said coupling device being in said second position when said sensing device is in a retaining position.

38. The dispenser of claim 37, said reserve roll support further including a vertically oriented contacting surface which is located horizontally between said one side wall and said projection, said coupling device contacting and urging said contacting surface to lock said projection within said guide track when said sensing device moves into a retaining position.

39. The dispenser of claim 35, said one guide track having front and rear opposing surfaces forming a guide channel therebetween, said rear opposing surface having a slot therein, said reserve roll support extending through said slot and into said guide channel when said reserve roll support is in a second position.

40. The dispenser of claim 39, the guide track of said one side wall having a top end for receiving a roll initially loaded into the dispenser, said pivot axis being located immediately adjacent said top end.

* * * * *

UNITED STATES PATENT AND TRADEMARK OFFICE

CERTIFICATE OF CORRECTION

PATENT NO. : 5,558,302

DATED : September 24, 1996

INVENTOR(S) : Paul W. Jespersen

It is certified that error appears in the above-indentified patent and that said Letters Patent is hereby corrected as shown below:

In Item [75], please replace "Jesperson" with --Jespersen--.

Column 5, Line 14, replace "Fig. 4,is" with --Fig. 4 is--.

Column 6, Line 41, replace "fight" with --right--.

Column 7, Line 4, replace "fight" with --right--.

Column 7, Line 6, replace "Left and right" with --Right and left--.

Column 7, Line 67, replace "to" with --∝--.

Column 14, Line 49, replace "fail" with --fall--.

Column 14, Line 55, replace "fails" with --falls--.

Column 14, Line 59, replace "fails" with --falls--.

Column 16, Line 37, replace "wail" with --wall--.

UNITED STATES PATENT AND TRADEMARK OFFICE

CERTIFICATE OF CORRECTION

PATENT NO. : 5,558,302

DATED : September 24, 1996

INVENTOR(S) : Paul W. Jespersen

It is certified that error appears in the above-indentified patent and that said Letters Patent is hereby corrected as shown below:

Column 17, Line 5, replace "dosed" with --closed--.

Signed and Sealed this

Fourth Day of February, 1997

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT : B1 5,558,302

DATED : January 4, 1994

INVENTOR(S) : Terry a. Welch

It is certified that error appears in the above-identified patent and that said Letters Patent is hereby corrected as shown below:

On the title page, the Assignee should read as follows:
--[73] Assignee: Unisys Corporation, Blue Bell, PA--.

Signed and Sealed this

Twelfth Day of January, 1999

*Attest:*

*Attesting Officer*

*Acting Commissioner of Patents and Trademarks*